US012759600B2

(12) United States Patent
Shoup et al.

(10) Patent No.: US 12,759,600 B2
(45) Date of Patent: Oct. 13, 2026

(54) RAILCAR DAMPING SYSTEM

(71) Applicant: A. Stucki Company, Moon Township, PA (US)

(72) Inventors: Joseph Michael Shoup, Imperial, PA (US); James Scott Kennedy, Zelienople, PA (US); Neil Aaron Brant, Oakdale, PA (US)

(73) Assignee: A. Stucki Company, Moon Township, PA (US)

( * ) Notice: Subject to any disclaimer, the term of this patent is extended or adjusted under 35 U.S.C. 154(b) by 1141 days.

(21) Appl. No.: 17/569,218

(22) Filed: Jan. 5, 2022

(65) Prior Publication Data

US 2022/0212699 A1 Jul. 7, 2022

Related U.S. Application Data

(60) Provisional application No. 63/203,295, filed on Jul. 16, 2021, provisional application No. 63/175,164, filed on Apr. 15, 2021, provisional application No. 63/134,302, filed on Jan. 6, 2021.

(51) Int. Cl.

| | |
|---|---|
| ***B61G 9/12*** | (2006.01) |
| ***B61G 9/04*** | (2006.01) |
| ***B61G 9/06*** | (2006.01) |
| ***B61G 9/22*** | (2006.01) |

(52) U.S. Cl.

CPC ..... *B61G 9/12* (2013.01); *B61G 9/04* (2013.01); *B61G 9/06* (2013.01); *B61G 9/22* (2013.01)

(58) Field of Classification Search

CPC ... B61G 9/06; B61G 9/04; B61G 9/22; B61G 7/10; B61G 9/24; B61G 11/18; B61G 3/04; B61G 9/12; B61G 9/10

See application file for complete search history.

(56) References Cited

U.S. PATENT DOCUMENTS

| | | | | |
|---|---|---|---|---|
| 1,964,170 A * | 6/1934 | O'Connor | ..... | B61G 9/24 213/65 |
| 2,724,513 A * | 11/1955 | Willison | ..... | B61G 9/06 213/50 |
| 3,759,400 A * | 9/1973 | Cope | ..... | F16F 1/40 213/40 R |

(Continued)

OTHER PUBLICATIONS

Office Action for Canadian Patent Application No. 3,204,192 dated Dec. 18, 2024.

(Continued)

*Primary Examiner* — Zachary L Kuhfuss

(74) *Attorney, Agent, or Firm* — Buchanan Ingersoll & Rooney PC

(57) ABSTRACT

Embodiments relate to a railcar damping system configured for placement in a railcar center sill having longitudinally spaced stops defining a center sill pocket. The system includes a damping assembly configured for receiving and dissipating external forces acting on a coupler connected to the damping system. Various embodiments of the damping system include a longitudinally moveable member, at least one stop and at least one follower block. Some embodiments include a housing. The shape, positioning, and configurations of these features allow for differentiated travel between buff and draft movements.

4 Claims, 32 Drawing Sheets

(56) References Cited

U.S. PATENT DOCUMENTS

| | | | | |
|---|---|---|---|---|
| 5,176,268 | A * | 1/1993 | Manley | B61G 7/10 213/50 |
| 9,598,092 | B2 | 3/2017 | James et al. | |
| 10,308,263 | B1 | 6/2019 | Ring et al. | |
| D857,554 | S * | 8/2019 | Schoedl | D12/47 |
| 10,384,696 | B2 | 8/2019 | Schoedl et al. | |
| 10,513,275 | B2 | 12/2019 | Ring et al. | |
| D963,520 | S * | 9/2022 | Schoedl | D12/47 |
| 2006/0043045 | A1 * | 3/2006 | Sommerfeld | B61G 9/22 213/75 R |
| 2007/0151941 | A1 | 7/2007 | Forbes | |
| 2015/0251651 | A1 | 9/2015 | Reed et al. | |
| 2016/0137212 | A1 | 5/2016 | James et al. | |
| 2018/0065649 | A1 | 3/2018 | Clark | |
| 2020/0385033 | A1 | 12/2020 | Schoedl et al. | |

OTHER PUBLICATIONS

International Search Report for PCT/US2022/011313 dated Mar. 25, 2022.

Written Opinion of the International Searching Authority for PCT/US2022/011313 dated Mar. 25, 2022.

* cited by examiner

RAILCAR DAMPING SYSTEM

CROSS-REFERENCE TO RELATED APPLICATIONS

This application is related to and claims the benefit of priority of U.S. Provisional Application Nos. 63/134,302 filed on Jan. 6, 2021, 63/175,164 filed on Apr. 15, 2021, and 63/203,295 filed on Jul. 16, 2021, the entire contents of each being incorporated herein by reference.

FIELD OF THE INVENTION

Embodiments relate to a railcar damping system that provides for differentiated travel between buff and draft movements and, in particular, the damping system allows for full compression in buff but limited compression in draft.

BACKGROUND OF THE INVENTION

A railcar damping system is a device that is positioned at or near an end of a railcar and is in mechanical connection with the railcar's coupler. When it is desired to couple a railcar to another railcar, one of the railcars is advanced towards the other to generate an impact coupling event—two couplers connect to each other to join the two railcars together. The damping system absorbs and controllably dissipates energy of the impact so as to reduce or eliminate damage to the railcars. This is known as a buff event. In addition, when a locomotive causes the railcars (after they have been coupled to each other) to move for transporting the railcars, the damping system absorbs and controllably dissipates energy to mitigate damage to the railcars. This is known as a draft event. During travel, the damping system again absorbs and dissipates energy via multiple buff and draft events to mitigate damage due to slack between railcars, start-stop motion, in-train forces, cycling, changes in topography, etc.

Conventional railcar damping systems provide means to absorb/dissipate energy, yet they generally provide the same energy absorption/dissipation in in both buff and draft. Benefits can be realized by having a damping system that provides for differentiated travel for buff and draft movements and, in particular, limited travel for draft. Conventional systems can be appreciated from U.S. Pat. Nos. 10,513,275, 10,384,696, 10,308,263, 9,598,092, and U.S. Publ. No. 2015/0251651.

The present disclosure is directed toward overcoming one or more of the above-mentioned problems, though not necessarily limited to embodiments that do.

SUMMARY OF THE INVENTION

Embodiments relate to a damping system facilitating travel in draft motion that differs from travel in buff motion—i.e., it is able to dissipate more energy in buff than in draft, protecting the car structure and lading during a buff event and limiting inter-car slack during a draft event. The damping system compresses in both buff and draft motions, but various features of the inventive damping system allow it to be compressed fully in the buff motion for maximum energy absorption, while limiting travel in the draft motion by not permitting full compression of the damping system so as to reduce inter-car slack.

An exemplary embodiment relates to a railcar damping system configured for placement in a railcar center sill having longitudinally spaced front and rear stops defining a center sill pocket. The system can have one or more front stops and one or more rear stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. The system includes a longitudinally moveable member having a side wall extending longitudinally along the center sill pocket and having proximal and distal ends and an end wall connected to the side wall distal end, the end wall being transverse to the longitudinal axis and extending into the yoke pocket. The system includes a follower block provided within the yoke pocket for movement along the longitudinal axis, the follower block being positioned transversely of the longitudinal axis and including a flange portion defining opposing proximal and distal facing stop sides. The front stop(s) is disposed at a proximal end of the center sill pocket and the rear stop(s) is disposed at a distal end of the center sill pocket. The front stop includes a proximal stop surface and a distally extending portion extending longitudinally and terminating in a distal stop surface. In buff movement, the follower block is urged toward the distal end of the center sill pocket and engages the damping assembly, and the flange portion of the follower block travels along the distally extending portion of the front stop and engages the side wall of the longitudinally moveable member defining a full buff position. In draft movement, the longitudinally moveable member is urged toward the proximal end of the center sill pocket until the proximal end of the longitudinally moveable member engages the distal stop surface of the front stop defining a full draft position.

Another exemplary embodiment relates to a railcar damping system configured for placement in a railcar center sill having longitudinally spaced front and rear stops defining a center sill pocket. The system can have one or more front stops and one or more rear stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. In some embodiments, the damping assembly includes a housing having a side wall extending longitudinally along the center sill pocket and having proximal and distal ends and an end wall connected to the side wall distal end, the end wall being transverse to the longitudinal axis and extending into the yoke pocket. The system includes a follower block provided within the yoke pocket for movement along the longitudinal axis, the follower block being positioned transversely of the longitudinal axis and including a flange portion defining opposing proximal and distal facing stop sides. The front stop(s) is disposed at a proximal end of the center sill pocket and the rear stop(s) is disposed at a distal end of the center sill pocket. The front stop includes a proximal stop surface and a distally extending portion extending longitudinally and terminating in a distal stop surface. In buff movement, the follower block is urged toward the distal end of the center sill pocket and engages the damping assembly, and the flange portion of the follower block travels along the distally extending portion of the front stop and engages the side wall of the housing defining a full buff position. In draft movement, the housing is urged toward the proximal end of the center sill pocket until the proximal end of the housing engages the distal stop surface of the front stop defining a full draft position.

Another exemplary embodiment relates to a railcar damping system configured for placement in a railcar center sill having longitudinally spaced front and rear stops defining a center sill pocket. The system can have one or more front stops and one or more rear stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. The system includes a longitudinally moveable member having a side wall extending longitudinally along the center sill pocket and having proximal and distal ends and an end wall connected to the side wall distal end, the end wall being transverse to the longitudinal axis and extending into the yoke pocket. The system includes a follower block provided within the yoke pocket for movement along the longitudinal axis, the follower block positioned transversely of the longitudinal axis and including a protrusion defining opposing proximal and distal facing stop sides. The front stop(s) is disposed at a proximal end of the center sill pocket and the rear stop(s) is disposed at a distal end of the center sill pocket. The front stop includes a proximal stop surface and two distally extending portions extending longitudinally and terminating in two distal stop surfaces. In buff movement, the follower block is urged toward the distal end of the center sill pocket and engages the damping assembly, and the protrusion of the follower block travels along the two distally extending portions of the front stop and engages the side wall of the longitudinally moveable member defining a full buff position. In draft movement, the longitudinally moveable member is urged toward the proximal end of the center sill pocket until the proximal end of the longitudinally moveable member engages the two distal stop surfaces of the front stop defining a full draft position.

Another exemplary embodiment relates to a railcar damping system configured for placement in a railcar center sill having longitudinally spaced front and rear stops defining a center sill pocket. The system can have one or more front stops and one or more rear stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. The damping assembly includes a housing having a side wall extending longitudinally along the center sill pocket and having proximal and distal ends and an end wall connected to the side wall distal end, the end wall transverse to the longitudinal axis and extending into the yoke pocket. The system includes a follower block provided within the yoke pocket for movement along the longitudinal axis, the follower block being positioned transversely of the longitudinal axis and including a protrusion defining opposing proximal and distal facing stop sides. The front stop(s) is disposed at a proximal end of the center sill pocket and the rear stop(s) is disposed at a distal end of the center sill pocket. The front stop includes a proximal stop surface and two distally extending portions extending longitudinally and terminating in two distal stop surfaces. In buff movement, the follower block is urged toward the distal end of the center sill pocket and engages the damping assembly, and the protrusion of the follower block travels along the two distally extending portions of the front stop and engages the side wall of the housing defining a full buff position. In draft movement, the housing is urged toward the proximal end of the center sill pocket until the proximal end of the housing engages the two distal stop surfaces of the front stop defining a full draft position.

Another exemplary embodiment relates to a railcar damping system configured for placement in a railcar center sill having longitudinally spaced front and rear stops defining a center sill pocket. The system can have one or more front stops and one or more rear stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. The system includes a longitudinally moveable member having a side wall extending longitudinally along the center sill pocket and having proximal and distal ends and an end wall connected to the side wall distal end, the end wall being transverse to the longitudinal axis and extending into the yoke pocket, the side wall having an extension extending longitudinally from the side wall proximal end. The system includes a follower block provided within the yoke pocket for movement along the longitudinal axis, the follower block being positioned transversely of the longitudinal axis and including a flange portion defining opposing proximal and distal facing stop sides. The front stop(s) is disposed at a proximal end of the center sill pocket and the rear stop(s) is disposed at a distal end of the center sill pocket. In buff movement, the follower block is urged toward the distal end of the center sill pocket and engages the damping assembly, and the flange portion of the follower block travels along the extension of the longitudinally moveable member and engages a distal stop surface of the longitudinal moveable member defining a full buff position. In draft movement, the longitudinally moveable member is urged toward the proximal end of the center sill pocket until a proximal stop surface of the longitudinal moveable member engages the front stop defining a full draft position.

Another exemplary embodiment relates to a railcar damping system configured for placement in a railcar center sill having longitudinally spaced front and rear stops defining a center sill pocket. The system can have one or more front stops and one or more rear stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. The damping assembly includes a housing having a side wall extending longitudinally along the center sill pocket and having proximal and distal ends and an end wall connected to the side wall distal end, the end wall being transverse to the longitudinal axis and extending into the yoke pocket, and the side wall having an extension extending longitudinally from the side wall proximal end. The system includes a follower block provided within the yoke pocket for movement along the longitudinal axis, the follower block being positioned transversely of the longitudinal axis and including a flange portion defining opposing proximal and distal facing stop sides. The front stop(s) is disposed at a proximal end of the center sill pocket and the rear stop(s) is disposed at a distal end of the center sill pocket. In buff movement, the follower block is urged toward the distal end of the center sill pocket and engages the damping assembly, and the flange portion of the follower block travels along the extension of the housing and engages a distal stop surface of the housing defining a full buff position. In draft movement, the housing is urged toward the proximal end of the center sill pocket until a proximal stop surface of the housing engages the front stop defining a full draft position.

Another exemplary embodiment relates to a railcar damping system configured for placement in a railcar center sill having longitudinally spaced front and intermediate stops defining a center sill pocket. The system can have one or more front stops and one or more intermediate stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. The system includes a longitudinally moveable member having a side wall extending longitudinally along the center sill pocket and having proximal and distal ends and an end wall connected to the side wall distal end, the end wall being transverse to the longitudinal axis and extending into the yoke pocket. The system includes a front follower block provided within the yoke pocket for movement along the longitudinal axis, the front follower block being positioned transversely of the longitudinal axis, the front follower block having opposing proximal and distal facing stop sides, and the front follower block being positioned between the front and intermediate stops. The system includes a rear follower block provided within the yoke pocket for movement along the longitudinal axis, the rear follower block being positioned transversely of the longitudinal axis, the rear follower block having opposing proximal and distal facing stop sides, and the rear follower block being positioned between the intermediate stop and the yoke distal end wall. The front stop(s) is disposed at a proximal end of the center sill pocket and the intermediate stop(s) is disposed at a location between the proximal and distal ends of the center sill pocket. In buff movement, the front follower block is urged toward the distal end of the center sill pocket and engages the damping assembly, and the front follower block further travels along the center sill pocket and engages the side wall of the longitudinal moveable member defining a full buff position. In draft movement, the rear follower block is urged toward the proximal end of the center sill pocket until the rear follower block engages the intermediate stop defining a full draft position.

Another exemplary embodiment relates to a railcar damping system configured for placement in a railcar center sill having longitudinally spaced front and intermediate stops defining a center sill pocket. The system can have one or more front stops and one or more intermediate stops. The system includes a yoke provided in the center sill pocket and having a longitudinal axis, the yoke including opposing top and bottom walls extending longitudinally and including a distal end wall connecting the top and bottom walls to define a yoke pocket. The system includes a damping assembly disposed in the yoke pocket and configured for receiving and dissipating external forces acting on a coupler connected to the yoke. The damping assembly includes a housing having a side wall extending longitudinally along the center sill pocket and having proximal and distal ends and an end wall connected to the side wall distal end, the end wall being transverse to the longitudinal axis and extending into the yoke pocket, and the side wall having a cut-out formed in a surface thereof defining a proximal cut-out surface and a distal cut-out surface. The system includes a follower block provided within the yoke pocket for movement along the longitudinal axis, the follower block being positioned transversely of the longitudinal axis, and the follower block having opposing proximal and distal facing stop sides. The front stop(s) is disposed at a proximal end of the center sill pocket and the intermediate stop(s) is disposed at a location between the proximal and distal ends of the center sill pocket. In buff movement, the follower block is urged toward the distal end of the center sill pocket and engages the damping assembly, and the follower block further travels along the center sill pocket and engages the side wall of the housing defining a full buff position. In draft movement, the housing is urged toward the proximal end of the center sill pocket until the distal cut-out surface engages the intermediate stop defining a full draft position.

Another exemplary embodiment related to a railcar damping system configured for placement in a railcar center sill having longitudinally spaced front and rear stops defining a center sill pocket. The railcar damping system includes a yoke provided in the center sill pocket and having a longitudinal axis. The yoke includes opposing top and bottom walls extending longitudinally, and further includes a distal end wall connecting the top and bottom walls to define a yoke pocket. The system includes a damping assembly disposed in the yoke pocket. The damping assembly is configured for receiving and dissipating external forces acting on a coupler connected to the yoke. The system includes a longitudinally moveable member having a side wall extending longitudinally along the center sill pocket and has proximal and distal ends and an end wall connected to the side wall distal end. The end wall is transverse to the longitudinal axis and extends into the yoke pocket. The system includes a follower block provided within the yoke pocket for movement along the longitudinal axis. The follower block is positioned transversely of the longitudinal axis and includes opposing proximal and distal facing stop sides. The front stop includes a proximal stop surface formed on an inner surface of the front stop and a distally extending portion extending longitudinally and terminating in a distal stop surface. In buff movement, the follower block is urged toward the distal end of the center sill pocket and engages the damping assembly. The follower block travels along the inner surface of the distally extending portion of the follower block and engages the side wall of the longitudinally moveable member defining a full buff position. In draft movement, the longitudinally moveable member is urged toward the proximal end of the center sill pocket until the proximal end of the longitudinally moveable member engages the distal stop surface of the front stop defining a full draft position.

Another exemplary embodiment relates to a railcar damping system configured for placement in a railcar center sill having longitudinally spaced front, intermediate, and rear stops defining a center sill pocket. The railcar damping system includes a yoke provided in the center sill pocket having a longitudinal axis. The yoke including opposing top and bottom walls extending longitudinally and includes a distal end wall connecting the top and bottom walls to define a yoke pocket. The system includes a damping assembly disposed in the yoke pocket and configured for receiving and dissipating external forces acting on a coupler connected to the yoke. The system includes a longitudinally moveable member having a side wall extending longitudinally along the center sill pocket and having proximal and distal ends and an end wall connected to the side wall distal end. The end wall is transverse to the longitudinal axis and extends into the yoke pocket. The system includes a follower block provided within the yoke pocket for movement along the longitudinal axis. The follower block is positioned transversely of the longitudinal axis and includes opposing proximal and distal facing stop sides. The front stop includes a stop surface formed at a distal end of the front stop. In buff movement, the follower block is urged toward the distal end of the center sill pocket and engages the damping assembly. The follower block travels past the intermediate stop and engages the side wall of the longitudinally moveable member defining a full buff position. In draft movement, the longitudinally moveable member is urged toward the proximal end of the center sill pocket until the proximal end of the longitudinally moveable member engages a distal stop surface of the intermediate stop defining a full draft position. The follower block can be any one of square shaped, rectangular shaped, H-shaped, or L-shaped.

It will be appreciated that the elements of the various embodiments are not limited to that particular embodiment, but may be interchangeably combined to form yet further embodiments, as contemplated herein and appreciated by one skilled in the art.

Embodiments of the damping system dissipate more energy and allow railcars to be impacted at higher speeds than a traditional draft gears, without transferring higher forces to the railcar structure and lading. The system does not require use of hydraulic fluids, which typically lead to leaking problems. The damping systems disclosed herein are also able to be installed into new cars or be retrofitted to replace existing damping systems (e.g., can be retrofit to replace End of Car Cushioning units in AAR EOC pockets). Additional benefits include:

- The damping System fits in most AAR End of Car Cushioning pockets including EOC-8, EOC-9, and EOC-10.
- A draft gear with increased buff travel capable of fitting into EOC pockets.
- A damping system that provides more cushioning in buff than traditional draft gears.
- A damping system that provides less travel in draft than in buff.
- A damping system that allows for use of an extended coupler to accommodate extended travel.
- A damping system that allows for use of a draft gear with friction clutch and either mechanical springs or elastomer springs with extended travel.
- A damping system that allows for use of an extended travel draft gear capable of 6-8 inches of travel.
- A damping system that achieves performance close to EOC units without using hydraulic cylinders.

Further features, aspects, objects, advantages, and possible applications of the present invention will become apparent from a study of the exemplary embodiments and examples described below, in combination with the Figures, and the appended claims.

BRIEF DESCRIPTION OF THE DRAWINGS

The above and other objects, aspects, features, advantages and possible applications of the present innovation will be more apparent from the following more particular description thereof, presented in conjunction with the following drawings. Like reference numbers used in the drawings may identify like components.

DETAILED DESCRIPTION OF THE INVENTION

The following description is of exemplary embodiments that are presently contemplated for carrying out the present invention. This description is not to be taken in a limiting sense, but is made merely for the purpose of describing the general principles and features of various aspects of the present invention. The scope of the present invention is not limited by this description.

Figure 1:
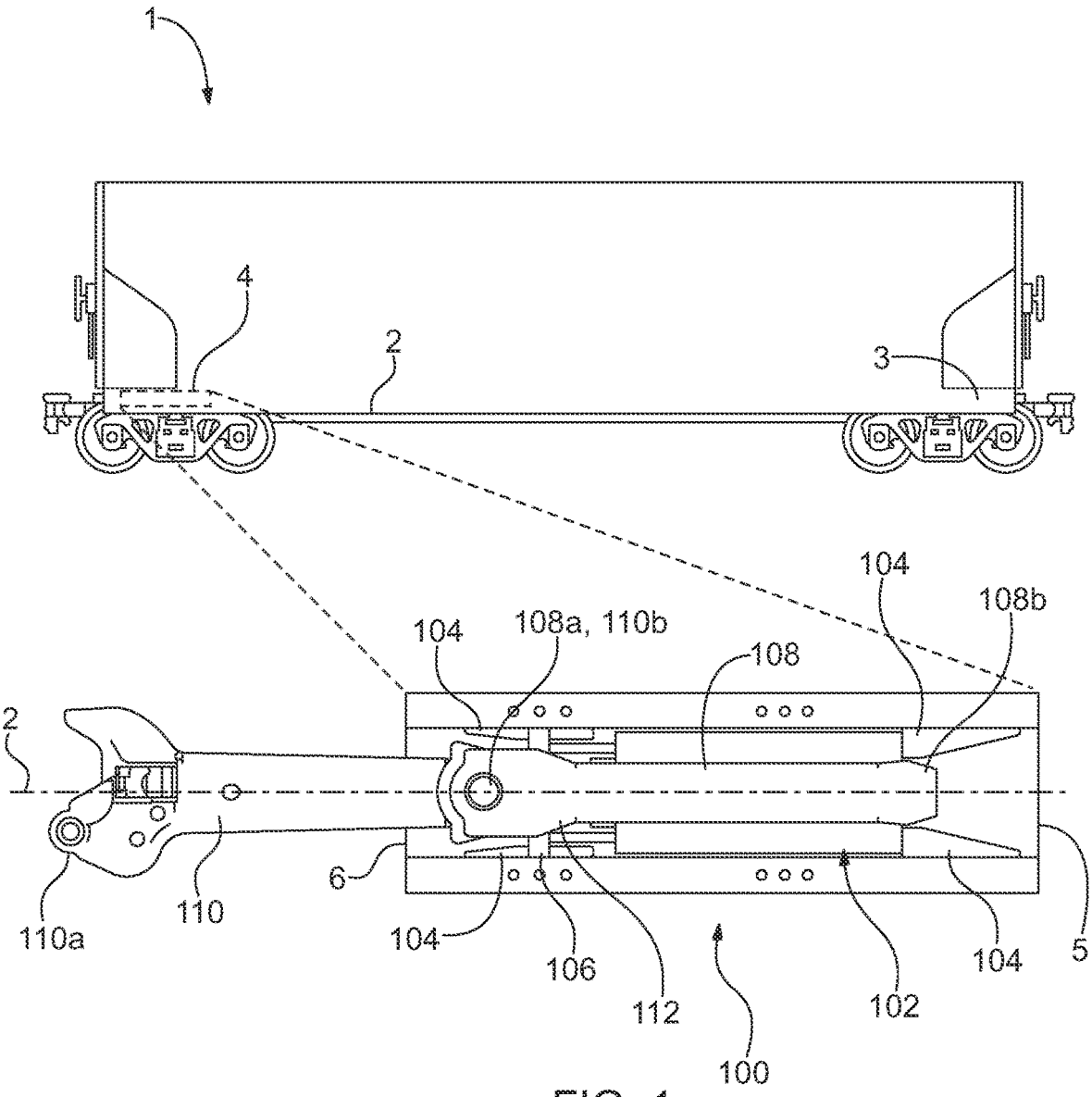
FIG. 1 shows a railcar and an exemplary damping system.
Figure 2:
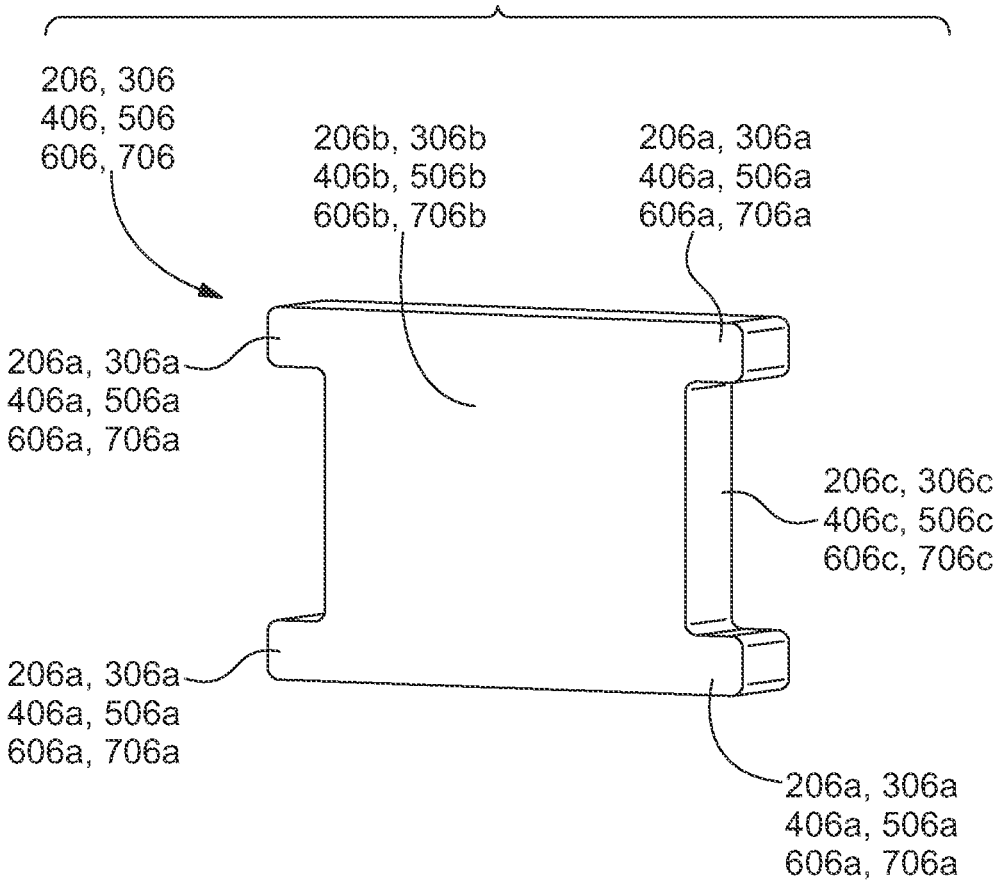
FIG. 2 shows exemplary follower block and stop configurations that may be used with an embodiment of the damping system.
Figure 2:
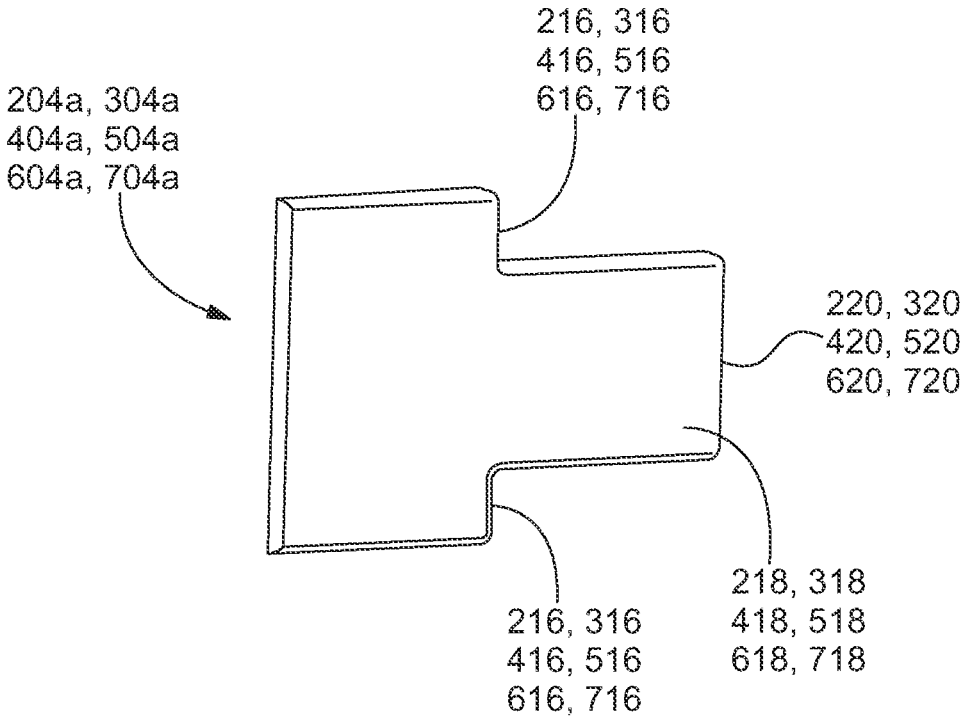

Referring to FIG. 1, embodiments relate to a damping system 100 for a railcar 1. Various embodiments of the damping system 100 include a damping means 102, stops 104 (sometimes referred to as lugs), at least one follower block 106, a yoke 108, and a coupler 110. The damping means 102 includes a member and other components (e.g., springs, elastomers, etc.) to facilitate damped longitudinal movement along a longitudinal axis 2 of the member. In some embodiments of the damping means 102, the member is or includes a longitudinal moveable member or a housing that contains the longitudinally moveable member and other components.

The damping means 102 is secured to a railcar frame 3. For instance, the railcar frame 3 has a center sill pocket 4 within which the damping means 102 is secured. The center sill pocket 4 of the railcar frame 3 is located at or near a distal end of the railcar 1, and is a square or rectangular pocket that is sized to receive the damping means 102. In an exemplary embodiment, the center sill pocket 4 is rectangular and is configured to have its long axis be aligned (coaxial or parallel) with the longitudinal axis 2 of the railcar 1. The damping means 102 is placed within the center sill pocket 4 so that its rear end is more distal relative to the distal end of the railcar 1 than its front end is. The damping means 102 is held in place within the center sill pocket 4 by front stops 104 and rear stops 104 (and in some cases intermediate stops 104) that are secured (e.g., via a fastener, weld, etc.) to the railcar frame 3, that form the center sill pocket 4. For instance, the center sill pocket 4 is sized to allow the damping means 102 to be inserted therein and be slid in a direction back and forth along the longitudinal axis 2 but be bounded in that longitudinal movement by the stops 104. The stops 104 are attached to the frame 3 and form or define the center sill pocket 4 so that when the damping means 102 moves, the longitudinal moveable member (and in some cases the housing) abuts against one of the stops 104 to arrest further movement. It is important to note that the damping means 102 is intended to move within the center sill pocket 4, but that the stops 104 bound that movement to achieve the desired level of draft and buff motion for the damping system 100.

A coupler 110 is mechanically connected to a yoke 108, each of which are rectangular or cylindrical members that is aligned with the longitudinal axis 2 of the railcar 1. The coupler 110 has a coupling end 110*a* and a yoke-engaging end 110*b*. The coupling end 110*a* is configured to mechanically couple to another coupler via coupling impact—e.g., the coupling end 110*a* can be a Janney style coupler, a SA3 style coupler, a Scharfenberg stype coupler, etc. The yoke-engaging end 110*b* can facilitate attachment to the yoke 108 via a pin-and-hole, a cotter-pin type securement, etc. The yoke 108 is a member that sides within the center sill pocket 4 but also surrounds, envelops, or cradles the damping means 102. For instance, the yoke 108 has a coupler-engaging end 108*a* (e.g., a pin-and-hole, a cotter-pin type securement, etc.) and a cradle end 108*b*. The cradle end 108*b* envelops the damping means 102. While the yoke 108 cradles the damping means 102, it also allows for relative motion between the yoke 108 and the damping means 102. Thus, when the coupler 110 is impacted, the coupler 110 and the yoke 108 are both caused to move towards the damping means 102—this is a buff motion. The coupler 110 and yoke 108 both move relative to the damping means 102 so as to allow the coupler's yoke-engaging end 110*b* to impact the longitudinal moveable member. Depending on the arrangement of the stops 104, the follower block 106, and the housing (if one is used), compression of the damping means 102 may begin at this point. When the coupler 110 is pulled, the coupler 110 and the yoke 108 are both caused to move away from the damping means 102—this is draft motion. The coupler 110 and yoke 108 both move relative to the damping means 102 so as to allow the cradle end 108*b* to impact the longitudinal moveable member (or the housing if one is used), thereby allowing further movement of the coupler 110 in that same direction to pull the damping means 102 along with it. Depending on the arrangement of the stops 104, follower bock 106, and the housing (if one is used), the damping means 102 is pulled along until it abuts a stop 104, causing a transfer of force to the railcar frame 3 and movement of the railcar 1.

As will be explained in more detail, the buff and draft motions can be controlled via different configurations and placements of the stops 104, follower blocks 106, and housing (if one is used).

Each embodiment of the damping means 102 has a longitudinal moveable member. Depending on the arrangement, some damping means 102 include a housing and some do not. In each embodiment, the damping means 102 is designed to fit within the center sill pocket 4 so that its rear end is adjacent the center sill pocket distal end 5, its front end is adjacent the center sill pocket proximal end 6, and movement of the longitudinal moveable member is along the longitudinal axis 2. The yoke 108 cradles the damping means 102 so that the cradle end 108*b* is situated within the center sill pocket distal end 5 and the coupler-engaging end 108*a* is situated within the center sill pocket proximal end 6. The coupler-engaging end 108*a* includes a step 112 (e.g. flange, bevel, collar, etc.) that causes the width of the yoke 108 to increase—i.e., the yoke 108 has a constant width starting from the cradle end 108*b* until the step 112, wherein at the step 112 the width increases just before the coupler-engaging end 108*a*.

The damping system 100 has a front follower block 106. The front follower block 106 is positioned within the center sill pocket 4 and is located between the longitudinal moveable member (or housing if one is used) and the step 112. Some embodiments include a rear follower block 106. The rear follower block 106 is positioned within the center sill pocket 4 and is located between the longitudinal moveable member (or housing if one is used) and the cradle end 108*b* of the yoke 108.

Discussion of the various embodiments of the damping system 100 will involve the damping system 100 being in a neutral position, a full buff position, and a full draft position. Discussions will also involve buff movement and draft movement. The damping system 100 is in a neutral position when the damping means 102 is minimally compressed (technically, there is always some amount of compression in the draft means 102 (i.e., draft gear) when it is installed into the center sill pocket 4 (i.e., draft sill assembly)) and when there is no draft motion or buff motion. The damping system 100 is in a buff position when the damping means 102 is compressed or compressing and there is a buff motion. When, during buff motion, the damping system 100 arrests longitudinal moveable member or housing movement, the damping system 100 is said to be in full buff position. Embodiments of the damping system 100 allow for full compression of the damping system 100 when in a full buff position. The damping system 100 is in a draft position when the damping means 102 is compressed or compressing and there is a draft motion. When, during draft motion, the damping system 100 arrests longitudinal moveable member or housing movement, the damping system 100 is said to be in a full draft position. Embodiments of the damping system 100 allow for partial compression of the damping system 100 when in a full draft position.

Buff Motion for all Embodiments

As the yoke 108 is moved in a buff motion, the coupler 110 advances and engages against the front follower block 106 to cause it to advance towards the longitudinal moveable member (or housing). As the buff motion continues, the front follower block 106 presses against the damping means 102 to cause compression of the damping means 102 until the damping system 100 experiences full compression. The stops 104 are out of the path of the yoke 108 but in the path of the longitudinal moveable member (or housing). When the damping means 102 is caused to move in buff motion, rear or intermediate stops 104 (depending on the embodiment) arrest movement of the longitudinal moveable member (or housing) beyond a certain point. This arrested movement of the longitudinal moveable member (or housing) allows the front follower block 106 to fully compress the damping means 102. When the longitudinal moveable member (or housing) movement is arrested and the damping means 102 is fully compressed, the damping system 100 is in full buff position. When in full buff position, no further movement towards the center sill pocket distal end 5 of the coupler 110, yoke 108, or longitudinal moveable member (or housing) can be achieved. Note that in full buff position, the damping means 102 is fully compressed.

Neutral Position For All Embodiments

After being in a full buff position, the damping means 102 extends, pushing (or at least biasing) the front follower block 106, yoke 108, and coupler 110 towards the center sill pocket proximal end 6. The damping means 102 can push the front follower block 106, yoke 108, and coupler 110 until the damping system 100 reaches a neutral position.

During a draft motion from a buff position, the coupler 110 and yoke 108 pull the longitudinal moveable member (or housing) towards the center sill pocket proximal end 6 so that the longitudinal moveable member (or housing) moves away from the rear or intermediate stops 104. As will be explained, the front stops 104 then come into play to limit the motion of the longitudinal moveable member (or housing) during further draft motion.

When leaving a buff position due to a draft motion or due to the biasing force of the damping means 102, the damping means 102 starts to decompress and transition the damping system 100 to a neutral position. When transitioning to the neutral position, the longitudinal moveable member (or housing) abuts against and advances the front follower block 106 towards the center sill pocket proximal end 6. This occurs until the front follower block 106 abuts a stop surface of the front stop 104 to arrest movement of the front follower block 106 any further towards the center sill pocket proximal end 6. At this point, the damping system 100 is in a neutral position.

Draft Motion For Embodiments Having Front And Rear Stops

For embodiments having front and rear stops 104, during further draft motion, the coupler 110 and yoke 108 pull the longitudinal moveable member (or housing) towards the center sill pocket proximal end 6 so that the longitudinal moveable member (or housing) moves away from the rear stops 104. The damping means 102 pushes against the front follower block 106, but because the follower block 106 is held stationary by the front stop 104, the damping means 102 begins to compress. The movement of the coupler 110 and yoke 108, as well as the compression of the damping means 102, continues until the longitudinal moveable member (or housing) abuts the front stop 104, thereby arresting any further movement of the longitudinal moveable member (or housing) towards the center sill pocket proximal end 6. At this point, the damping system 100 is in full draft position. Note the damping means 102 is not fully compressed in the full draft position.

Draft Motion for Embodiments Having Front and Intermediate Stops and Front and Rear Follower Blocks For embodiments having front and intermediate stops 104 and front and rear follower blocks 106, during further draft motion, the coupler 110 and yoke 108 pull the longitudinal moveable member (or housing) towards the center sill pocket proximal end 6 so that the longitudinal moveable member (or housing) moves away from the intermediate stops 104. The damping means 102 pushes against the front follower block 106, but because the front follower block 106 is held stationary by the front stop 104, the damping means 102 begins to compress. The movement of the coupler 110 and yoke 108, as well as the compression of the damping means 102, continues until the rear follower block 106 abuts the intermediate stop 104, thereby arresting any further movement of the longitudinal moveable member towards the center sill pocket proximal end 6. At this point, the damping system 100 is in full draft position. Note the damping means 102 is not fully compressed in the full draft position.

Draft Motion for Embodiments Having Front and Intermediate Stops and a Front Follower Block For embodiments having front and intermediate stops 104 and a front follower block 106, during further draft motion, the coupler 110 and yoke 108 pull the housing towards the center sill pocket proximal end 6 so that the housing moves away from the intermediate stops 104. The damping means 102 pushes against the follower block 106, but because the follower block 106 is held stationary by the front stop 104, the damping means 102 begins to compress. The movement of the coupler 110 and yoke 108, as well as the compression of the damping means 102, continues until a cut-out in the housing abuts the intermediate stop 104, thereby arresting any further movement of the housing towards the center sill pocket proximal end 6. At this point, the damping system 100 is in full draft position. Note the damping system 100 is not fully compressed in the full draft position.

Detailed Description of Various Embodiments

Figure 3:
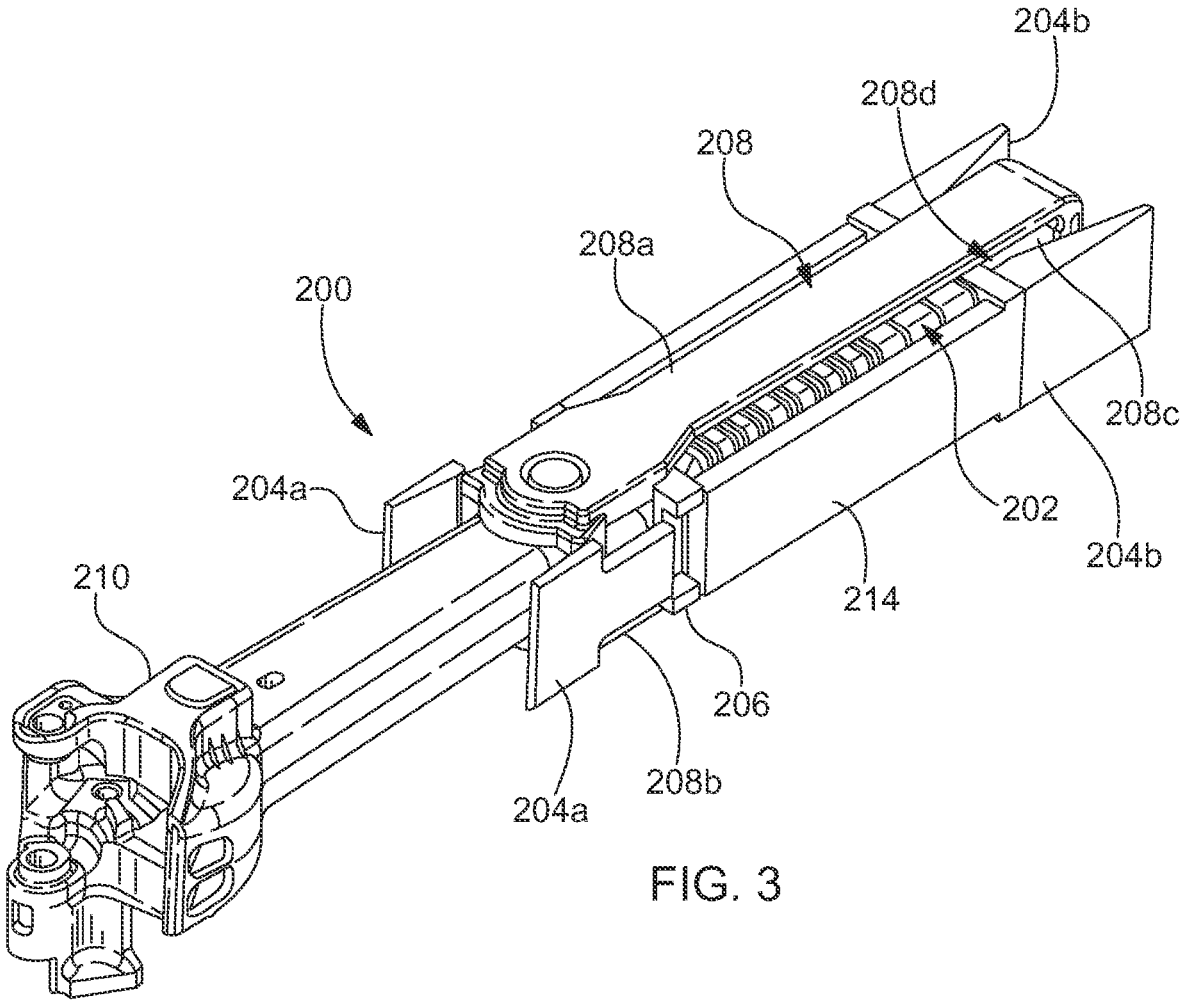
FIGS. 3-5 show an exemplary embodiment of the damping system, in a full buff, full draft, and neutral position, respectively.
Figure 4:
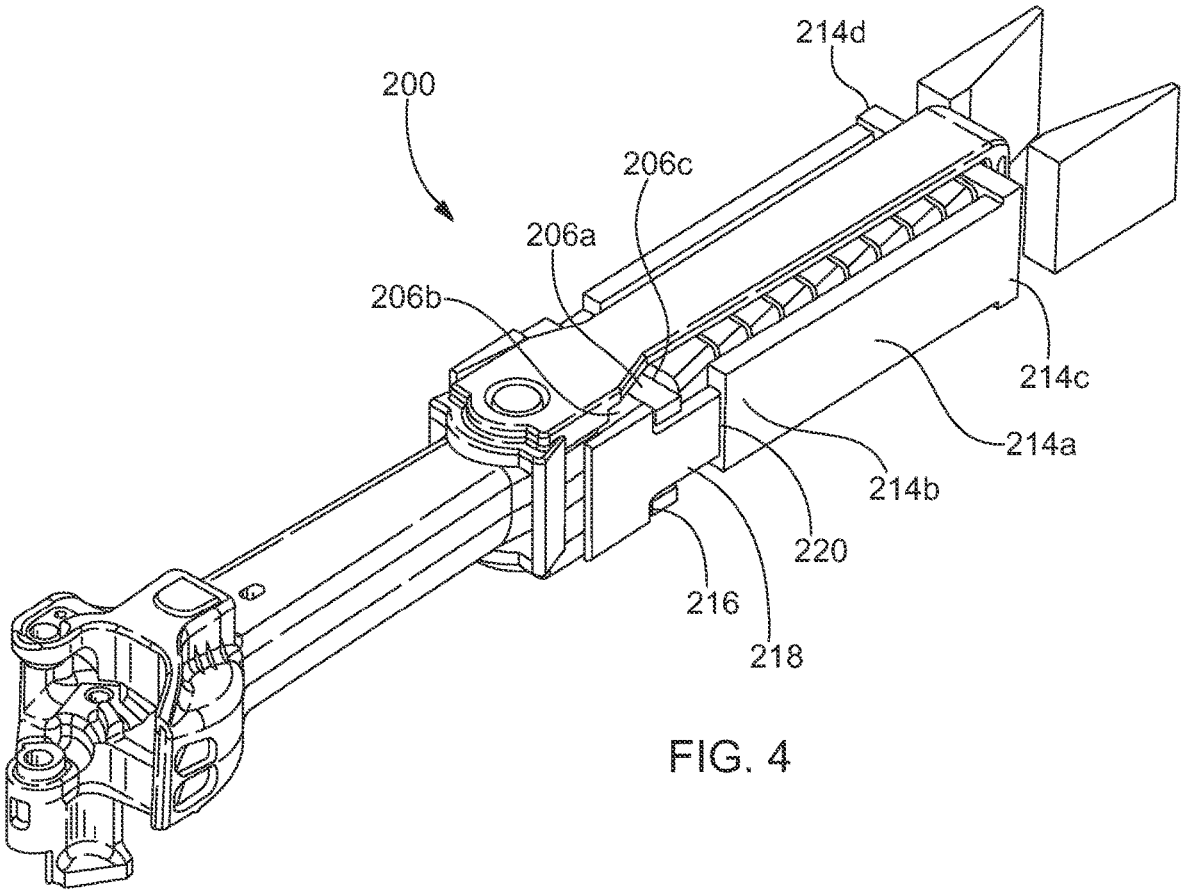
Figure 5:
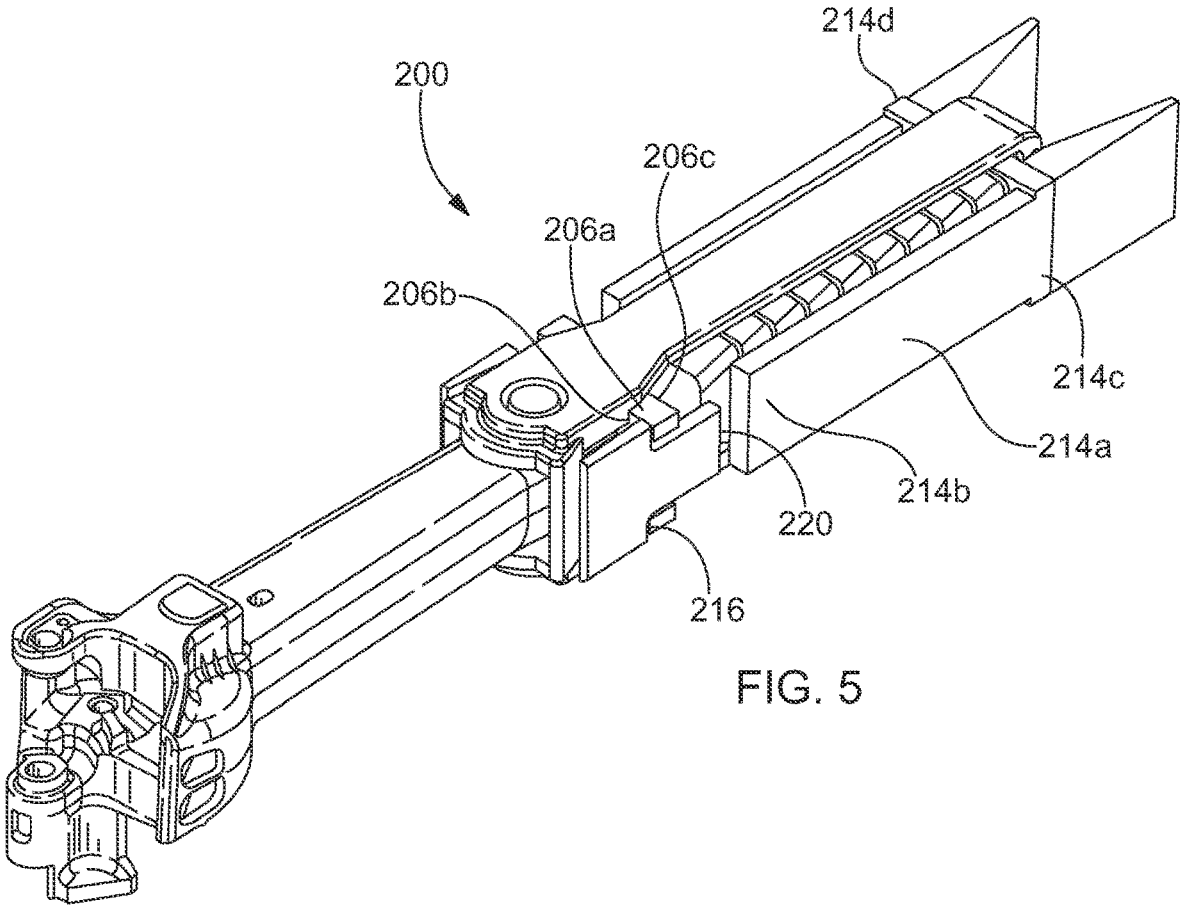

Referring to FIGS. 3-5, a first embodiment of the railcar damping system 200 is illustrated. The railcar center sill pocket 4 has longitudinally spaced front and rear stops 204*a*, 204*b*, defining a center sill pocket 4. The damping system 200 can have one or more front stops 204*a* and one or more rear stops 204*b*. For instance, the damping system 200 can have two front stops 204*a*, each positioned on either side of the frame 3 at a proximal end 6 of the center sill pocket 4. The damping system 200 can have two rear stops 204*b*, each positioned on either side of the frame 3 at a distal end 5 of the center sill pocket 4. A yoke 208 is provided in the center sill pocket 4, the yoke 208 being an elongated member and oriented along the longitudinal axis 2. The yoke 208 has opposing top and bottom walls 208*a*, 208*b* extending longitudinally. The yoke 208 further has a distal end wall 208*c* connecting the top and bottom walls 208*a*, 208*b* to define a yoke pocket 208*d*. A damping assembly 202 (or damping means) is disposed in the yoke pocket 208*d*, and is configured for receiving and dissipating external forces acting on a coupler 210 connected to the yoke 208.

The damping system 200 includes a longitudinally moveable member 214 having at least one side wall 214*a* extending longitudinally along the center sill pocket 4. The longitudinally moveable member 214 has proximal and distal ends 214*b*, 214*c* and an end wall 214*d* connected to the side wall distal end 214*c*. The end wall 214*d* is configured to be transverse to the longitudinal axis 2 and to extend into the yoke pocket 208*d*.

The damping system 200 has a follower block 206 positioned within the yoke pocket 208*d* for movement along the longitudinal axis 2. The follower block 206 is positioned transversely of the longitudinal axis 2 and includes a flange portion 206*a* defining opposing proximal and distal facing stop sides 206*b*, 206*c*. For instance, the follower block 206 can be a planar member that is I-shaped or H-shaped, such a shape having a web portion and at least one flange portion 206*a*.

The embodiment shown in FIGS. 3-5 has two front stops 204*a* and two rear stops 204*b*. Each front stop 204*a* is disposed at a proximal end 6 of the center sill pocket 4. Each rear stop 204*b* is disposed at a distal end 5 of the center sill pocket 4. At least one front stop 204*a* includes a proximal stop surface 216 and a distally extending portion 218 extending longitudinally and terminating in a distal stop surface 220. For instance, the front stop 204*a* can be a planar member that is T-shaped, such shape having a tail that is the distally extending portion 218.

In buff movement, the follower block 106 is urged toward the distal end 5 of the center sill pocket 4 and engages the damping assembly 202. The flange portion 206*a* of the follower block 106 travels along the distally extending portion 218 of the front stop 204*a* and engages the side wall 214*a* of the longitudinally moveable member 214, defining a full buff position.

In draft movement, the longitudinally moveable member 214 is urged toward the proximal end 6 of the center sill pocket 4 until the proximal end 214*b* of the longitudinally moveable member 214 engages the distal stop surface 220 of the front stop 204*a*, defining a full draft position.

The rear stops 204*b* in this embodiment can be in a shape other than square or rectangular. For instance, the rear stops 204*b* can be wedge shaped. The front stops 204*a* can also exhibit a taper so as to be wider at the distal stop surface 220 but narrow at proximal stop surface 216.

Figure 6:
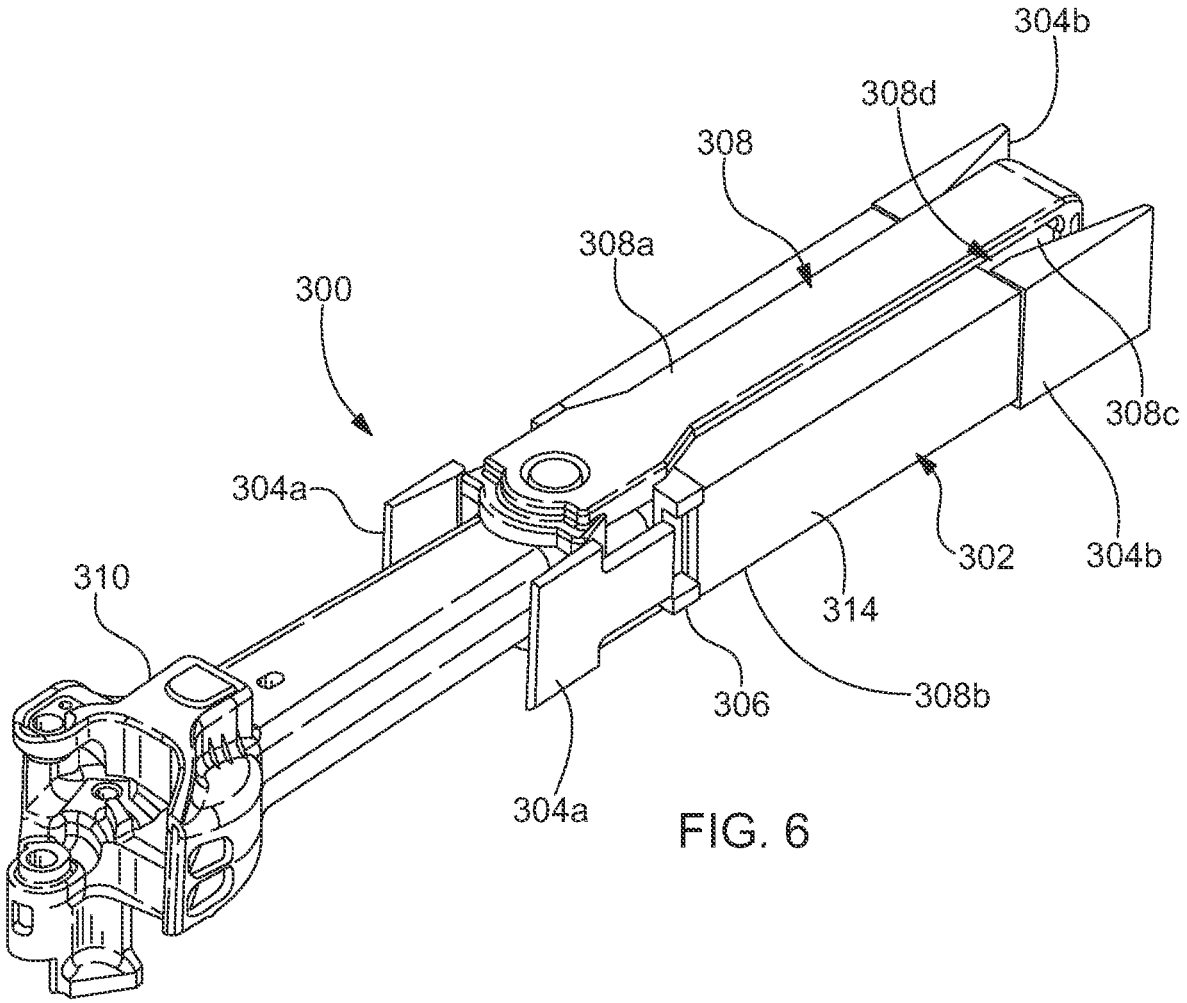
FIGS. 6-8 show another exemplary embodiment of the damping system, in a full buff, full draft, and neutral position, respectively.
Figure 7:
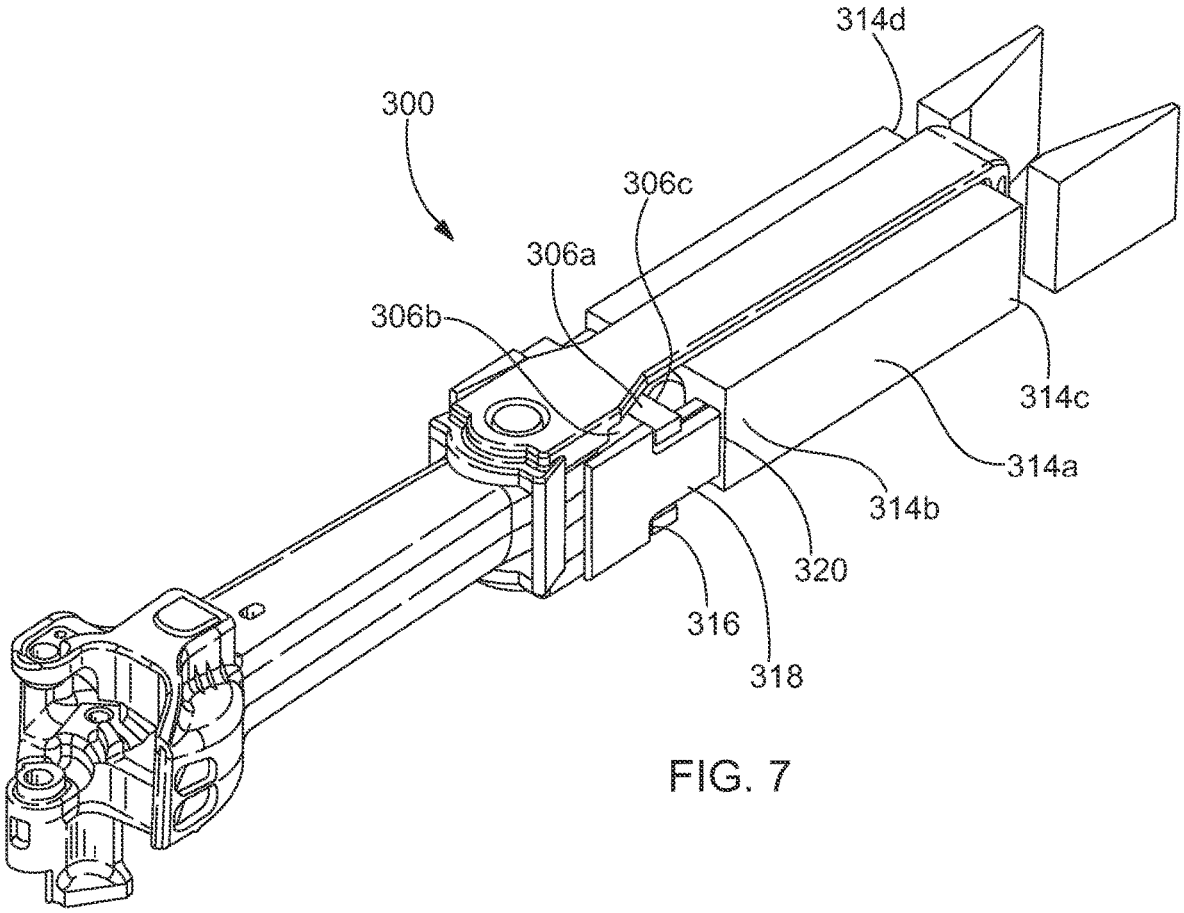
Figure 8:
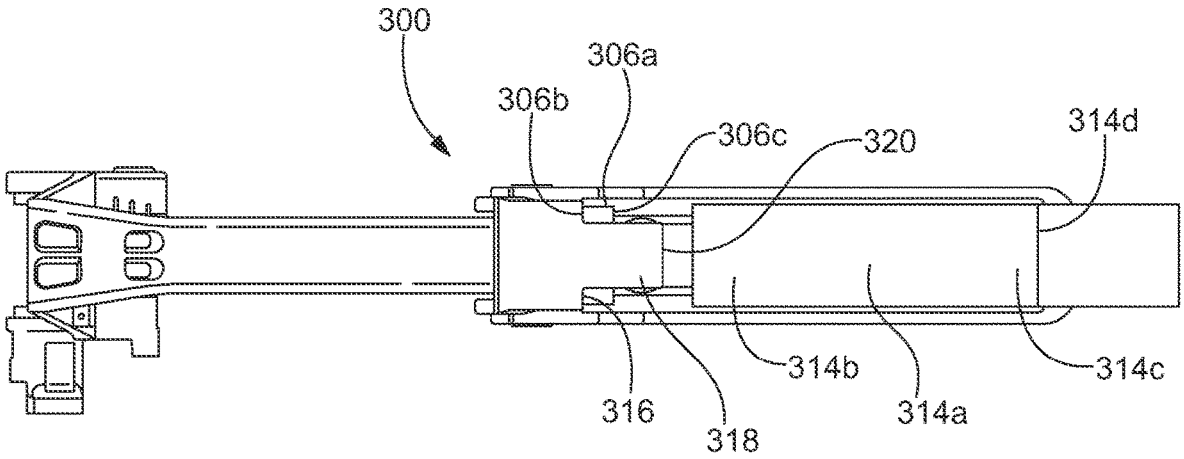

Referring to FIGS. 6-8, a second embodiment of the railcar damping system 300 is illustrated. The railcar center sill pocket 4 has longitudinally spaced front and rear stops 304*a*, 304*b*, defining a center sill pocket 4. The damping system 300 can have one or more front stops 304*a* and one or more rear stops 304*b*. For instance, the damping system 300 can have two front stops 304*a*, each positioned on either side of the frame 3 at a proximal end 6 of the center sill pocket 4. The damping system 300 can have two rear stops 304*b*, each positioned on either side of the frame 3 at a distal end 5 of the center sill pocket 4. A yoke 308 is provided in the center sill pocket 4, the yoke 308 being an elongated member and oriented along the longitudinal axis 2. The yoke 308 has opposing top and bottom walls 308*a*, 308*b* extending longitudinally. The yoke 308 further has a distal end wall 308*c* connecting the top and bottom walls 308*a*, 308*b* to define a yoke pocket 308*d*. A damping assembly 302 (or damping means) is disposed in the yoke pocket 308*d*, and is configured for receiving and dissipating external forces acting on a coupler 310 connected to the yoke 308.

The damping system 300 includes a housing 314 having at least one side wall 314*a* extending longitudinally along the center sill pocket 4. The housing 314 has proximal and distal ends 314*b*, 314*c* and an end wall 314*d* connected to the side wall distal end 314*c*. The end wall 314*d* is configured to be transverse to the longitudinal axis 2 and to extend into the yoke pocket 308*d*.

The damping system 300 has a follower block 306 positioned within the yoke pocket 308*d* for movement along the longitudinal axis 2. The follower block 306 is positioned transversely of the longitudinal axis 2 and includes a flange portion 306*a* defining opposing proximal and distal facing stop sides 306*b*, 306*c*. For instance, the follower block 306 can be a planar member that is I-shaped or H-shaped, such a shape having a web portion and at least one flange portion 306*a*.

The embodiment shown in FIGS. 6-8 has two front stops 304*a* and two rear stops 304*b*. Each front stop 304*a* is disposed at a proximal end 6 of the center sill pocket 4. Each rear stop 304*b* is disposed at a distal end 5 of the center sill pocket 4. At least one front stop 304*a* includes a proximal stop surface 316 and a distally extending portion 318 extending longitudinally and terminating in a distal stop surface 320. For instance, the front stop 304*a* can be a planar member that is T-shaped, such shape having a tail that is the distally extending portion 318.

In buff movement, the follower block 306 is urged toward the distal end 5 of the center sill pocket 4 and engages the damping assembly 302. The flange portion 306*a* of the follower block 306 travels along the distally extending portion 318 of the front stop 304*a* and engages the side wall 314*a* of the housing 314, defining a full buff position.

In draft movement, the housing 314 is urged toward the proximal end 6 of the center sill pocket 4 until the proximal end 314*b* of the housing 314 engages the distal stop surface 320 of the front stop 304*a*, defining a full draft position.

The rear stops 304*b* in this embodiment can be in a shape other than square or rectangular. For instance, the rear stops 304*b* can be wedge shaped. The front stops 304*a* can also exhibit a taper so as to be wider at the distal stop surface 320 but narrow at proximal stop surface 316.

Figure 9:
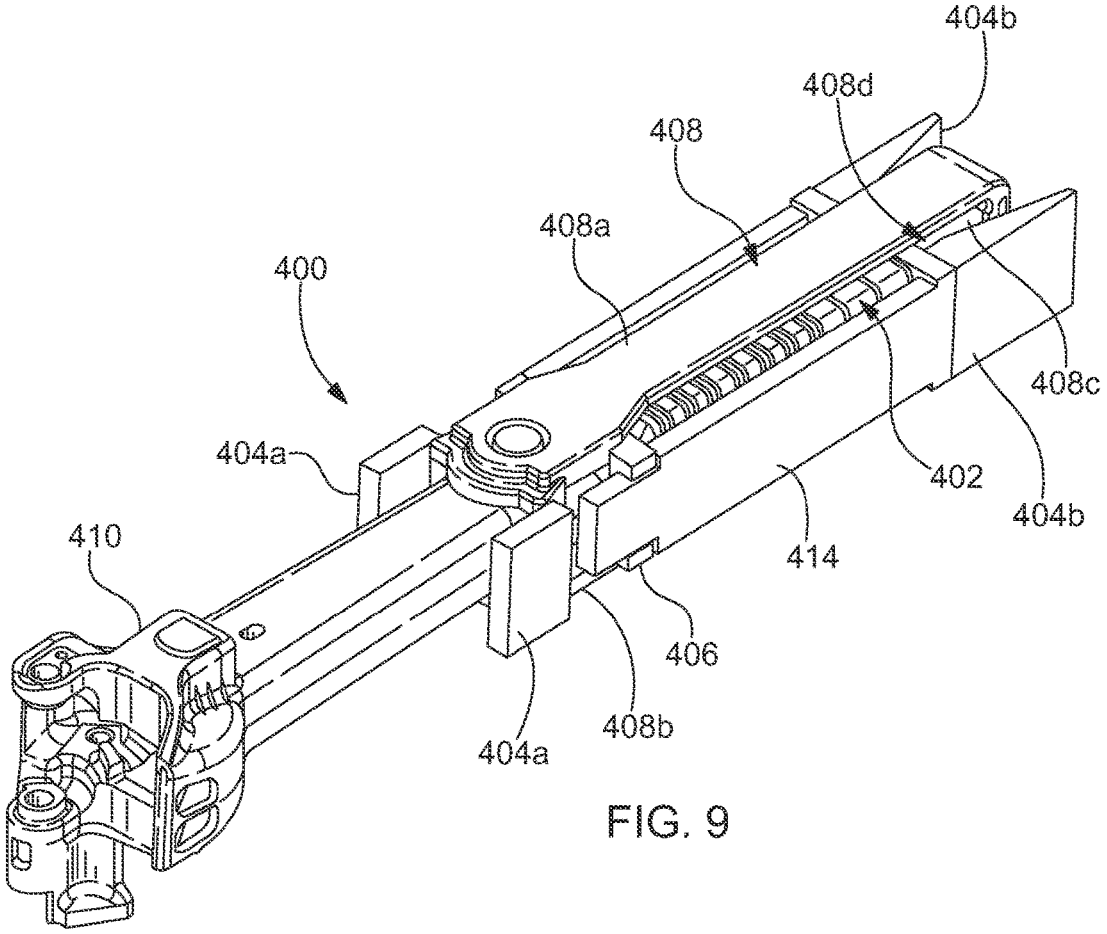
FIGS. 9-11 show another exemplary embodiment of the damping system, in a full buff, full draft, and neutral position, respectively.
Figure 10:
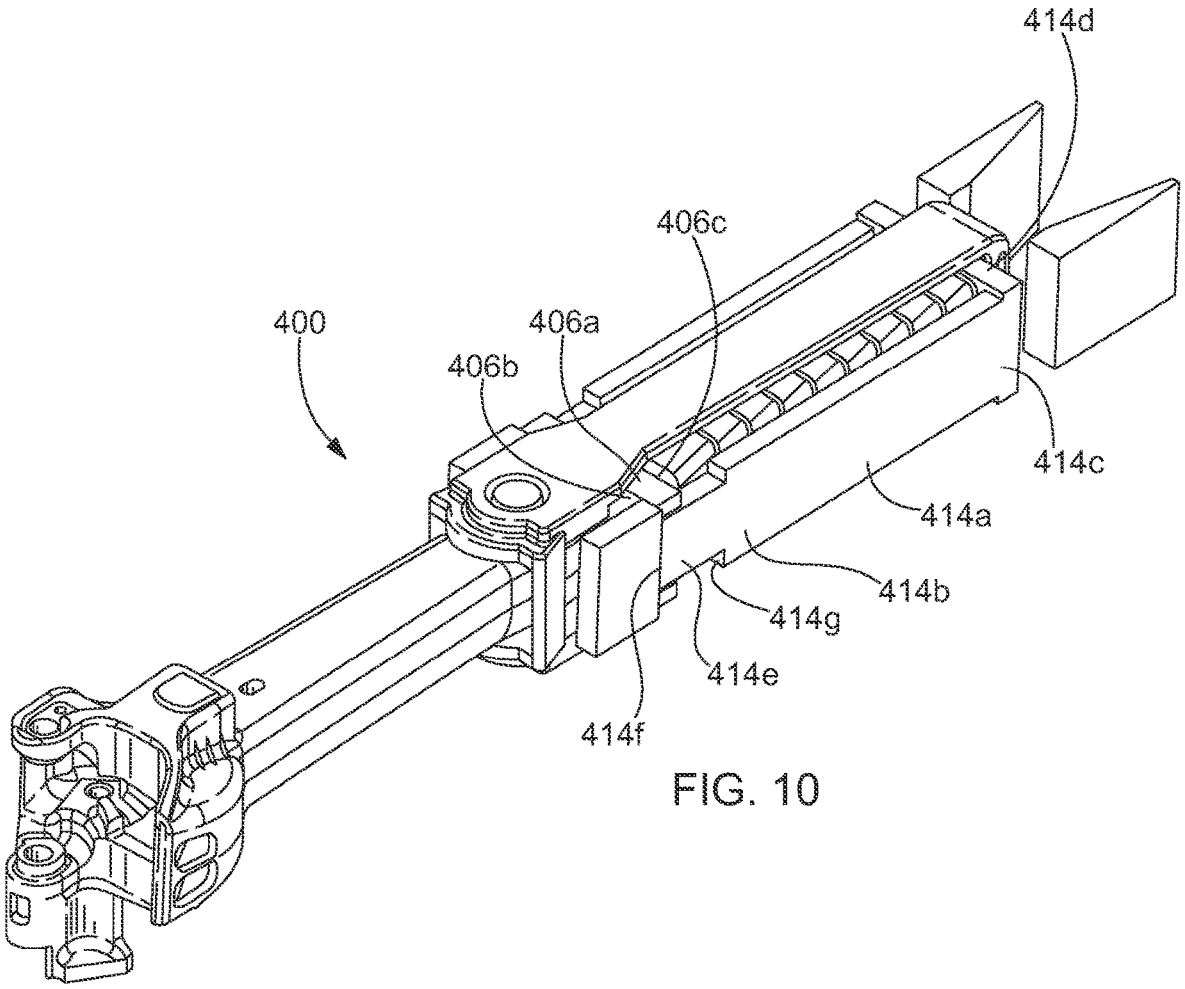
Figure 11:
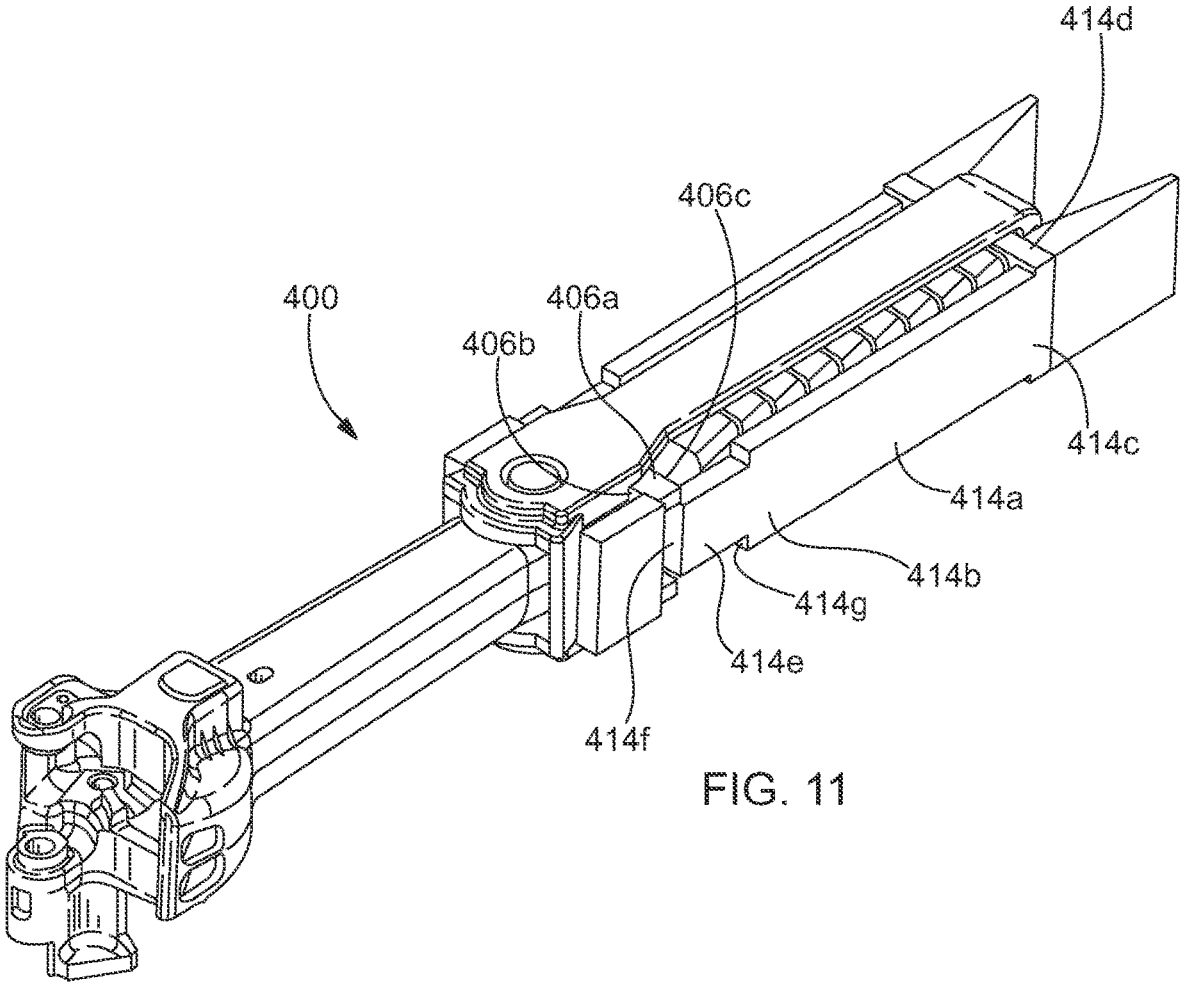

Referring to FIGS. 9-11, a third embodiment of the railcar damping system 400 is illustrated. The railcar center sill pocket 4 has longitudinally spaced front and rear stops 404*a*, 404*b*, defining a center sill pocket 4. The damping system 400 can have one or more front stops 404*a* and one or more rear stops 404*b*. For instance, the damping system 400 can have two front stops 404*a*, each positioned on either side of the frame 3 at a proximal end 6 of the center sill pocket 4. The damping system 400 can have two rear stops 404*b*, each positioned on either side of the frame 3 at a distal end 5 of the center sill pocket 4. A yoke 408 is provided in the center sill pocket 4, the yoke 408 being an elongated member and oriented along the longitudinal axis 2. The yoke 408 has opposing top and bottom walls 408*a*, 408*b* extending longitudinally. The yoke 408 further has a distal end wall 408*c* connecting the top and bottom walls 408*a*, 408*b* to define a yoke pocket 408*d*. A damping assembly 402 (or damping means) is disposed in the yoke pocket 408*d*, and is configured for receiving and dissipating external forces acting on a coupler 410 connected to the yoke 408.

The damping system 400 includes a longitudinally moveable member 414 having at least one side wall 414*a* extending longitudinally along the center sill pocket 4. The longitudinally moveable member 414 has proximal and distal ends 414*b*, 414*c* and an end wall 414*d* connected to the side wall distal end 414*c*. The end wall 414*d* is configured to be transverse to the longitudinal axis 2 and to extend into the yoke pocket 408*d*. The side wall 414*a* of the longitudinally moveable member 414 has an extension 414*e* extending longitudinally from the side wall proximal end 414*b*. For instance, the side wall 414*a* can be T-shaped, such shape having a tail that is the extension 414*e*.

The damping system 400 has a follower block 406 positioned within the yoke pocket 408*d* for movement along the longitudinal axis 2. The follower block 406 is positioned transversely of the longitudinal axis 2 and includes a flange portion 406*a* defining opposing proximal and distal facing stop sides 406*b*, 406*c*. For instance, the follower block 406 can be a planar member that is I-shaped or H-shaped, such a shape having a web portion and at least one flange portion 406*a*.

The embodiment shown in FIGS. 9-11 has two front stops 404*a* and two rear stops 404*b*. Each front stop 404*a* is disposed at a proximal end 6 of the center sill pocket 4. Each rear stop 404*b* is disposed at a distal end 5 of the center sill pocket 4. The front and rear stops 404*a*, 404*b* in this embodiment can be square or rectangular.

The extension 414*e* of the side wall 414*a* of the longitudinally moveable member 414 has a proximal stop surface 414*f* and a distal stop surface 414*g*.

In buff movement, the follower block 406 is urged toward the distal end 5 of the center sill pocket 4 and engages the damping assembly 402, and the flange portion 406*a* of the follower block 406 travels along the extension 414*e* of the longitudinally moveable member 414 and engages a distal stop surface 414*g* of the longitudinal moveable member 414, defining a full buff position.

In draft movement, the longitudinally moveable member 414 is urged toward the proximal end 6 of the center sill pocket 4 until a proximal stop surface 414*f* of the longitudinal moveable member 414 engages the front stop 404*a*, defining a full draft position.

The rear stops 404*b* in this embodiment can be in a shape other than square or rectangular. For instance, the rear stops 404*b* can be wedge shaped.

Figure 12:
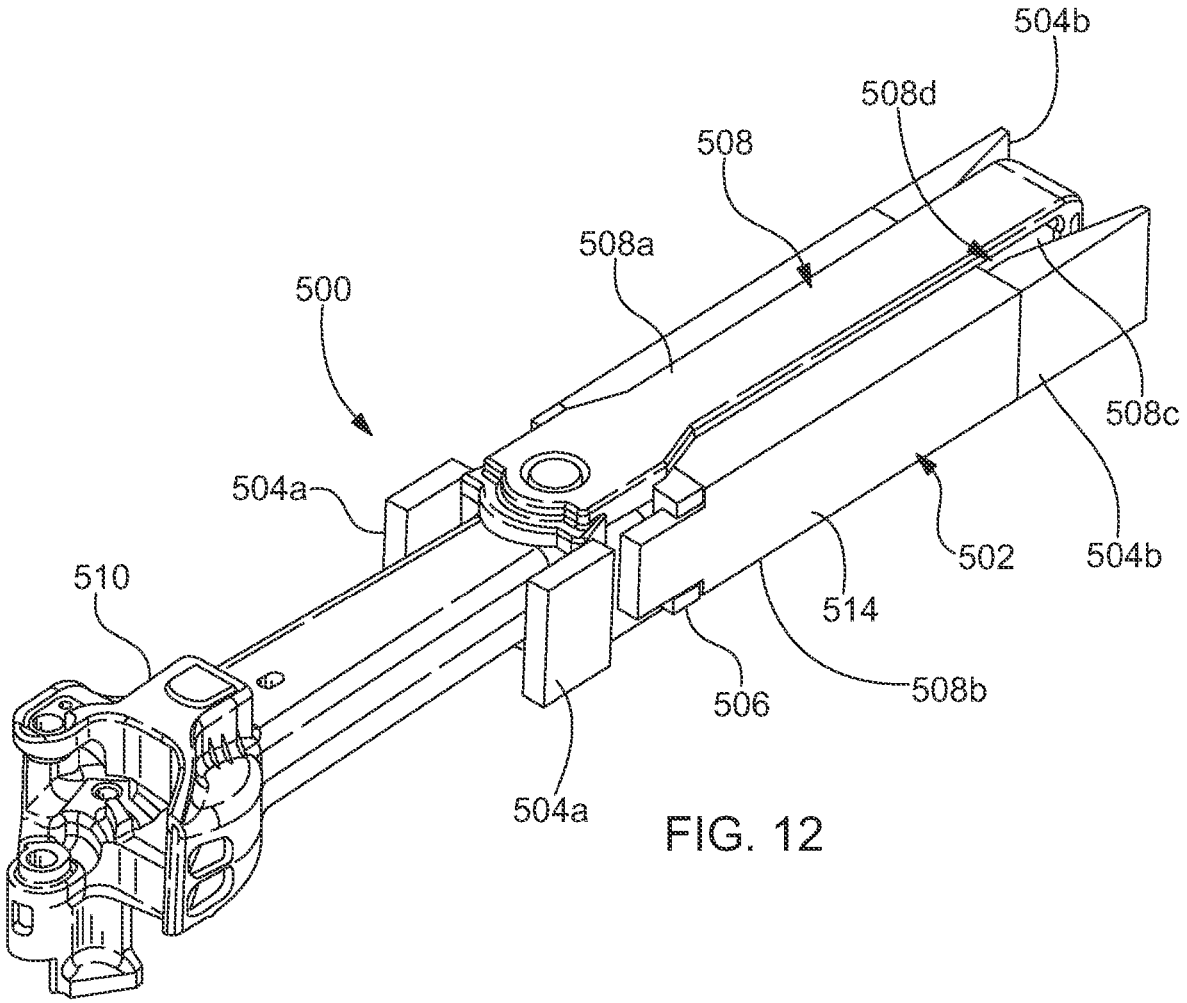
FIGS. 12-14 show another exemplary embodiment of the damping system, in a full buff, full draft, and neutral position, respectively.
Figure 13:
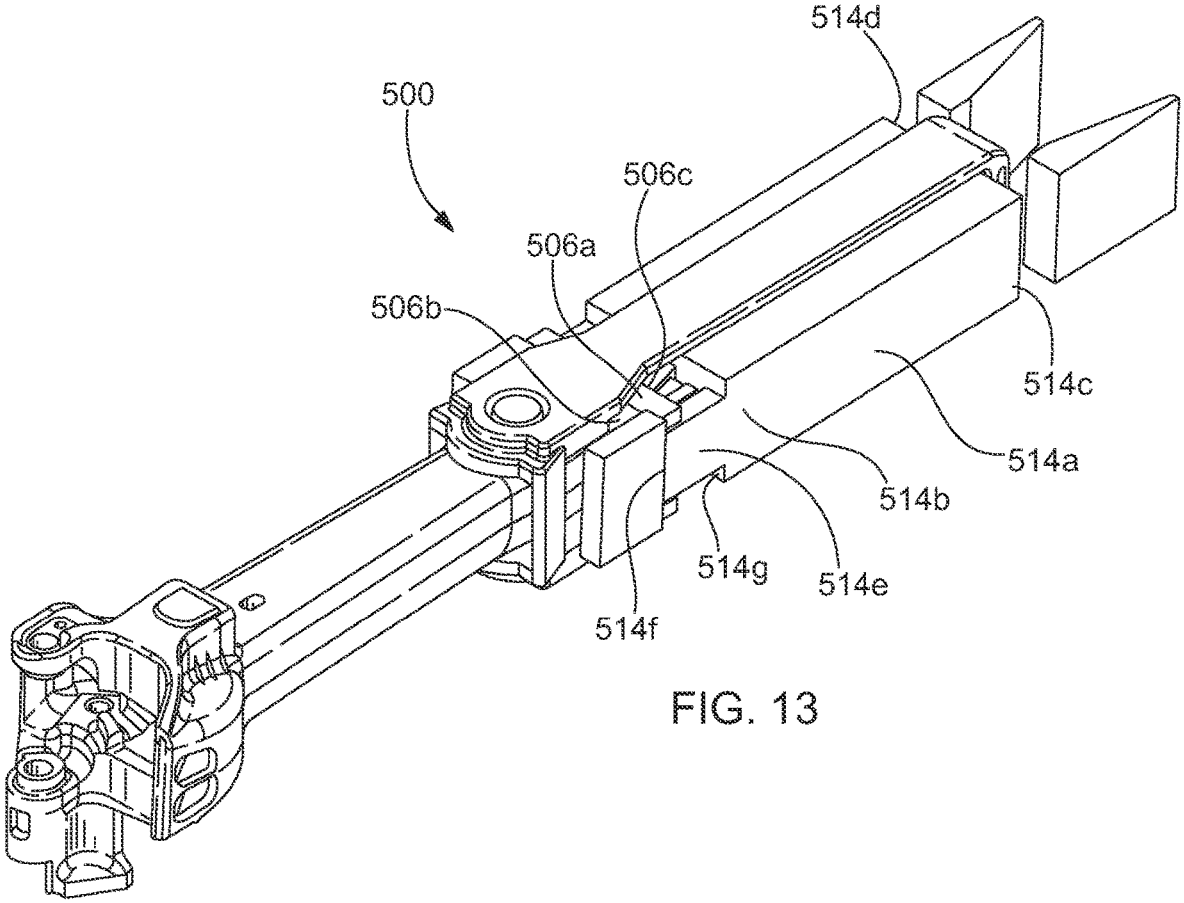
Figure 14:
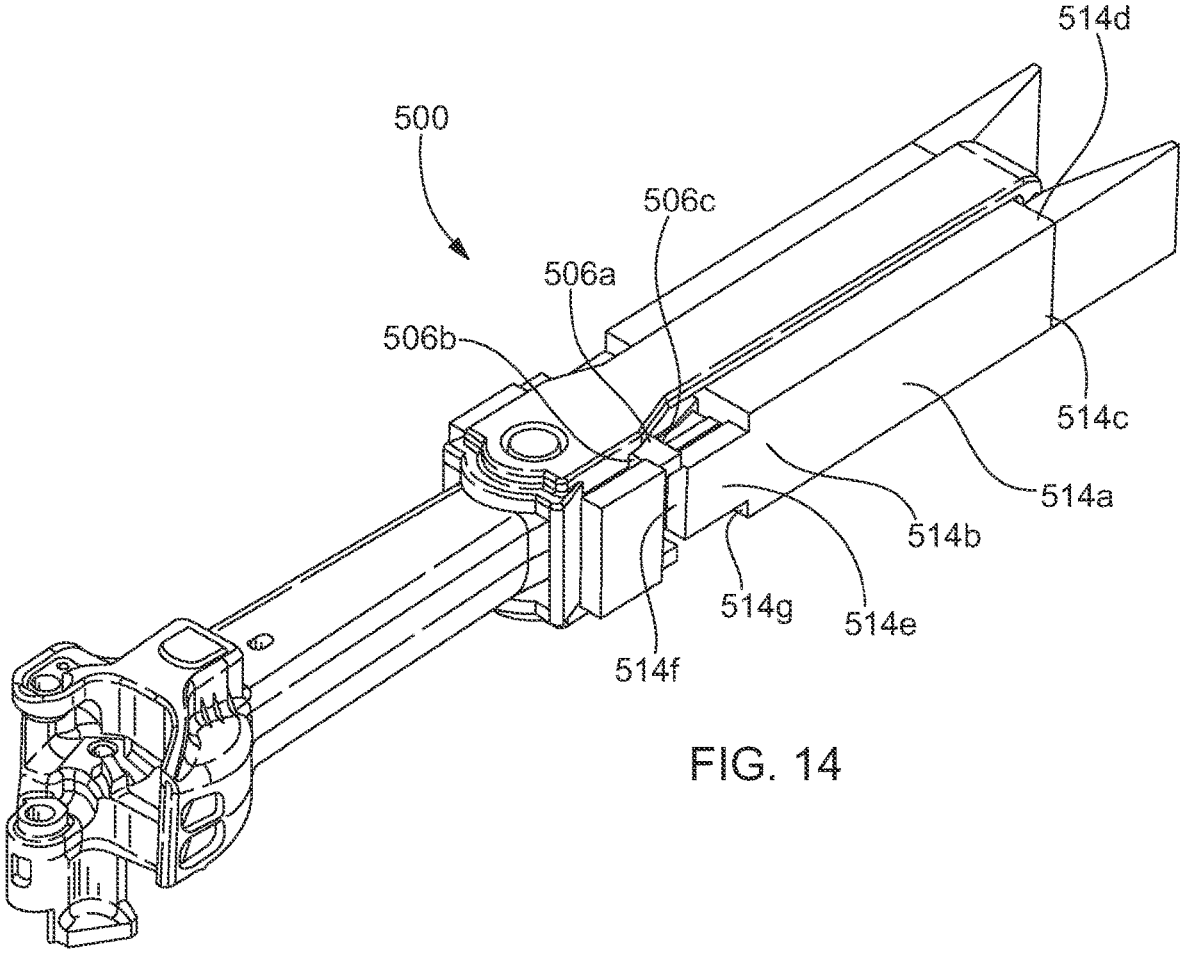

Referring to FIGS. 12-14, a fourth embodiment of the railcar damping system 500 is illustrated. The railcar center sill pocket 4 has longitudinally spaced front and rear stops 504*a*, 504*b*, defining a center sill pocket 4. The damping system 500 can have one or more front stops 504*a* and one or more rear stops 504*b*. For instance, the damping system 500 can have two front stops 504*a*, each positioned on either side of the frame 3 at a proximal end 6 of the center sill pocket 4. The damping system 500 can have two rear stops 504*b*, each positioned on either side of the frame 3 at a distal end 5 of the center sill pocket 4. A yoke 508 is provided in the center sill pocket 4, the yoke 508 being an elongated member and oriented along the longitudinal axis 2. The yoke 508 has opposing top and bottom walls 508*a*, 508*b* extending longitudinally. The yoke 508 further has a distal end wall 508*c* connecting the top and bottom walls 508*a*, 508*b* to define a yoke pocket 508*d*. A damping assembly 502 (or damping means) is disposed in the yoke pocket 508*d*, and is configured for receiving and dissipating external forces acting on a coupler 510 connected to the yoke 508.

The damping system 500 includes a housing 514 having at least one side wall 514*a* extending longitudinally along the center sill pocket 4. The housing 514 has proximal and distal ends 514*b*, 514*c* and an end wall 514*d* connected to the side wall distal end 514*c*. The end wall 514*d* is configured to be transverse to the longitudinal axis 2 and to extend into the yoke pocket 508*d*. The side wall 514*a* of the housing 514 has an extension 514*e* extending longitudinally from the side wall proximal end 514*b*. For instance, the side wall 514*a* can be T-shaped, such shape having a tail that is the extension 514*e*.

The damping system 500 has a follower block 506 positioned within the yoke pocket 508*d* for movement along the longitudinal axis 2. The follower block 506 is positioned transversely of the longitudinal axis 2 and includes a flange portion 506*a* defining opposing proximal and distal facing stop sides 506*b*, 506*c*. For instance, the follower block 506 can be a planar member that is I-shaped or H-shaped, such a shape having a web portion and at least one flange portion 506*a*.

The embodiment shown in FIGS. 12-14 has two front stops 504*a* and two rear stops 504*b*. Each front stop 504*a* is disposed at a proximal end 6 of the center sill pocket 4. Each rear stop 504*b* is disposed at a distal end 5 of the center sill pocket 4. The front and rear stops 504*a*, 504*b* in this embodiment can be square or rectangular.

The extension 514*e* of the side wall 514*a* of the housing 514 has a proximal stop surface 514*f* and a distal stop surface 514*g*.

In buff movement, the follower block 506 is urged toward the distal end 5 of the center sill pocket 4 and engages the damping assembly 502, and the flange portion 506*a* of the follower block 506 travels along the extension 514*e* of the housing 514 and engages a distal stop surface 514*g* of the housing 514, defining a full buff position.

In draft movement, the housing 514 is urged toward the proximal end 6 of the center sill pocket 4 until a proximal stop surface 514*f* of the housing 514 engages the front stop 504*a*, defining a full draft position.

The rear stops 504*b* in this embodiment can be in a shape other than square or rectangular. For instance, the rear stops 504*b* can be wedge shaped.

Figure 15:
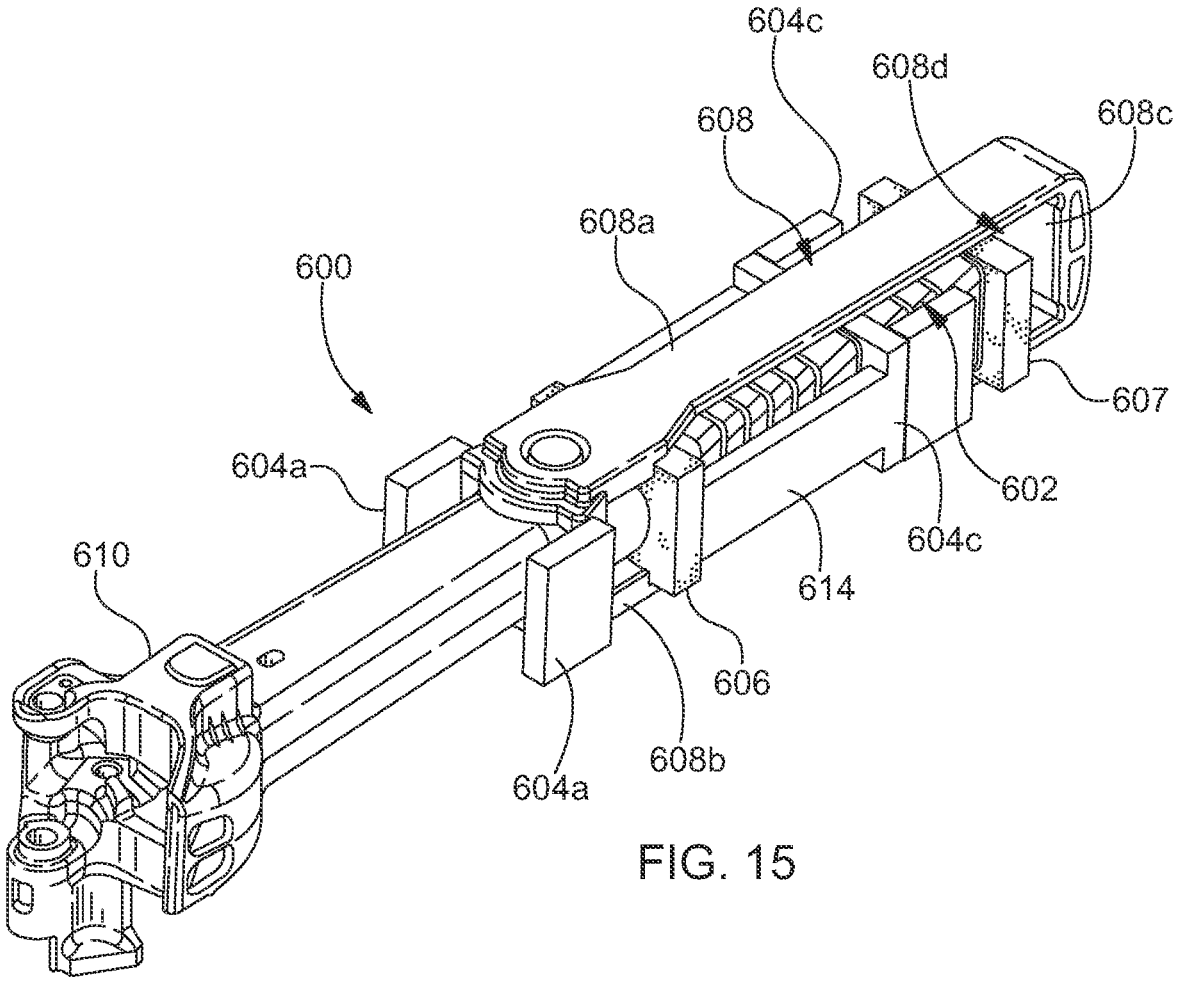
FIGS. 15-17 show another exemplary embodiment of the damping system, in a full buff, full draft, and neutral position, respectively.
Figure 16:
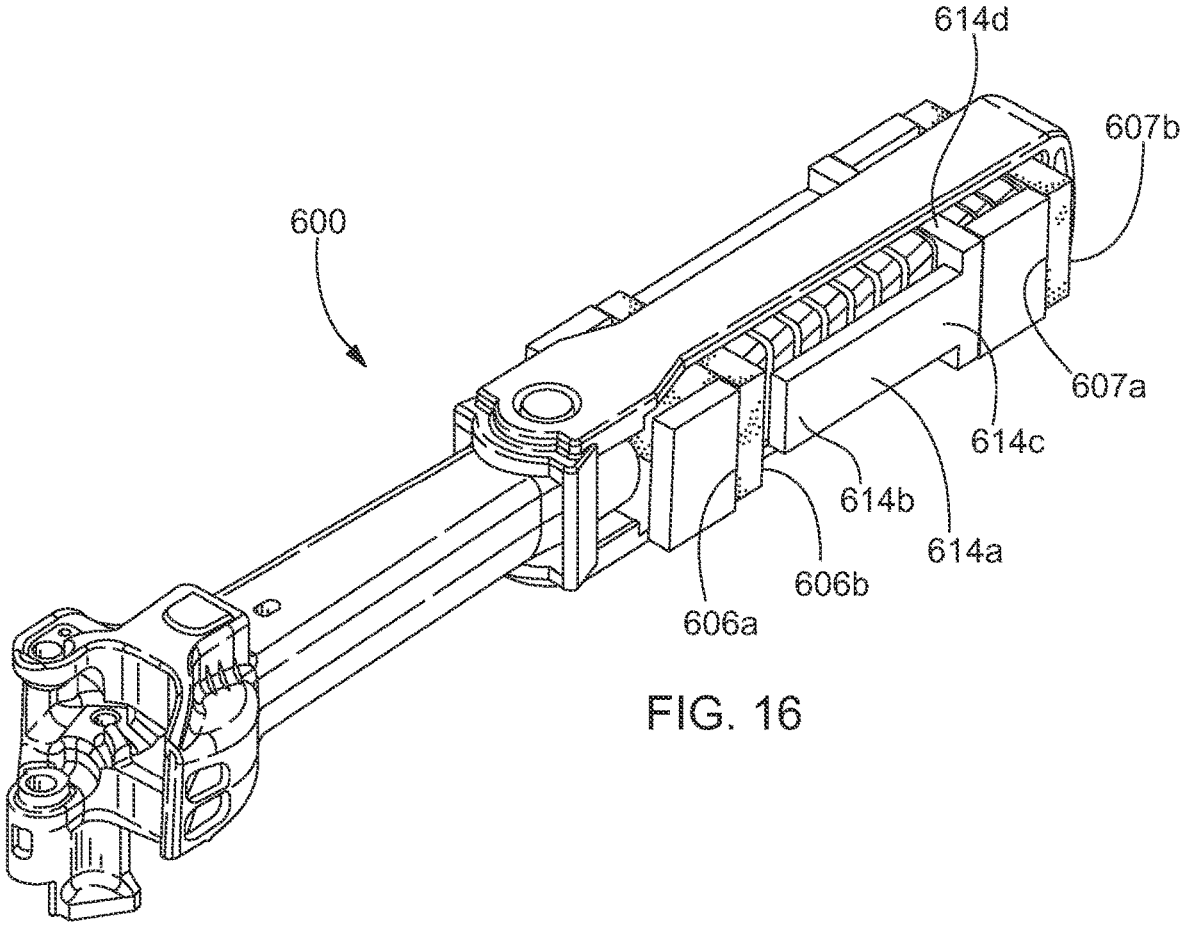
Figure 17:
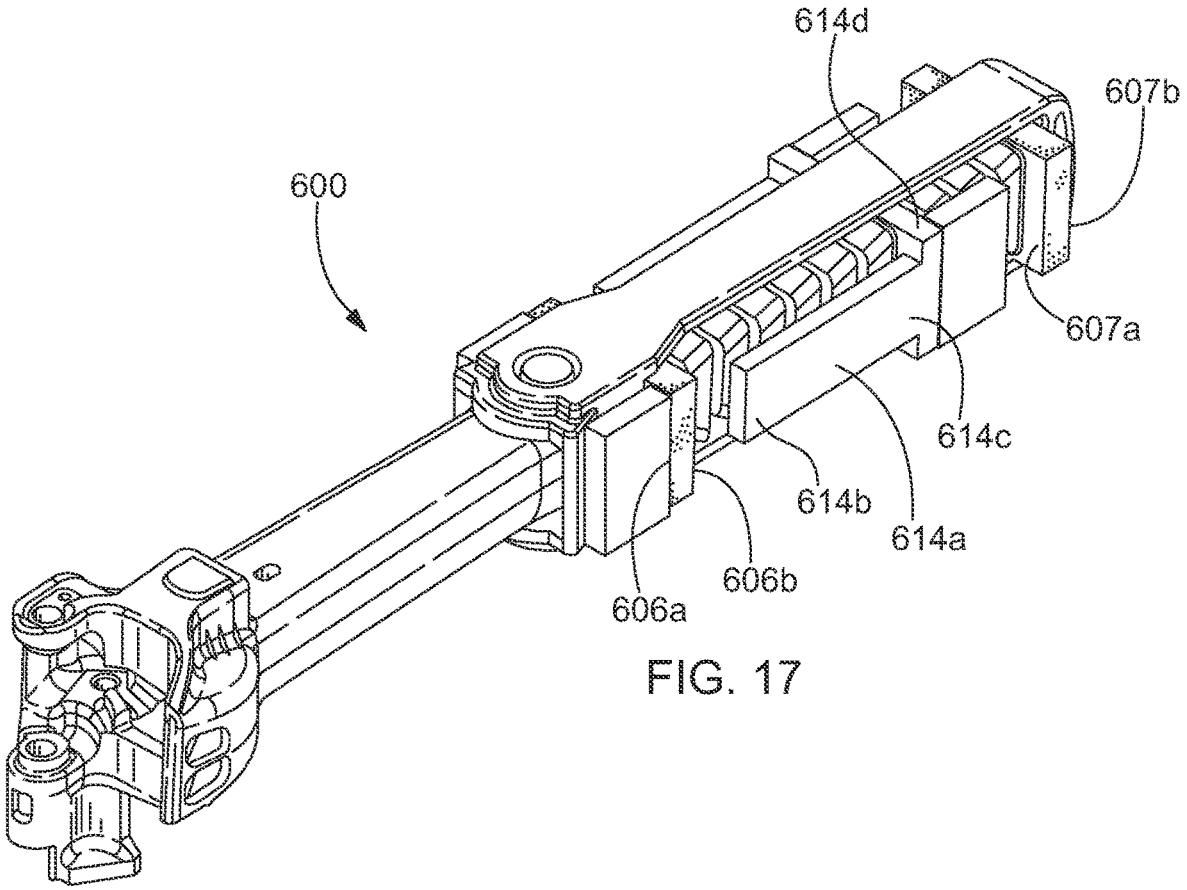

Referring to FIGS. 15-17, a fifth embodiment of the railcar damping system 600 is illustrated. The railcar center sill pocket 4 has longitudinally spaced front and intermediate stops 604*a*, 604*c*, defining a center sill pocket 4. The damping system 600 can have one or more front stops 604*a* and one or more intermediate stops 604*c*. For instance, the damping system 600 can have two front stops 604*a*, each positioned on either side of the frame 3 at a proximal end 6 of the center sill pocket 4. The damping system 600 can have two intermediate stops 604*c*, each positioned on either side of the frame 3 at a position between the proximal and distal ends 6, 5 of the center sill pocket 4. A yoke 608 is provided in the center sill pocket 4, the yoke 608 being an elongated member and oriented along the longitudinal axis 2. The yoke 608 has opposing top and bottom walls 608*a*, 608*b* extending longitudinally. The yoke 608 further has a distal end wall 608*c* connecting the top and bottom walls 608*a*, 608*b* to define a yoke pocket 608*d*. A damping assembly 602 (or damping means) is disposed in the yoke pocket 608*d*, and is configured for receiving and dissipating external forces acting on a coupler 610 connected to the yoke 608.

The damping system 600 includes a longitudinally moveable member 614 having at least one side wall 614*a* extending longitudinally along the center sill pocket 4. The longitudinally moveable member 614 has proximal and distal ends 614*b*, 614*c* and an end wall 614*d* connected to the side wall distal end 614*c*. The end wall 614*d* is configured to be transverse to the longitudinal axis 2 and to extend into the yoke pocket 608*d*.

The damping system 600 has a front follower block 606 positioned within the yoke pocket 608*d* for movement along the longitudinal axis 2. The front follower block 606 is positioned transversely of the longitudinal axis 2. The front follower block 606 has opposing proximal and distal facing stop sides 606*a*, 606*b*, and it is positioned between the front and intermediate stops 604*a*, 604*c*. The front follower block 606 can be a planar member that is square or rectangular shaped.

The damping system 600 has a rear follower block 607 positioned within the yoke pocket 608*d* for movement along the longitudinal axis 2. The rear follower block 607 is positioned transversely of the longitudinal axis 2. The rear follower block 607 has opposing proximal and distal facing stop sides 607*a*, 607*b*. The rear follower block 607 is positioned between the intermediate stop 604*c* and the yoke distal end wall 608*c*. The rear follower block 607 can be a planar member that is square or rectangular shaped.

The embodiment shown in FIGS. 15-17 has two front stops 604*a* and two intermediate stops 604*c*. Each front stop 604*a* is disposed at a proximal end 6 of the center sill pocket 4. Each intermediate stop 604*c* is disposed at a location between the proximal and distal ends 6, 5 of the center sill pocket 4. The front and intermediate stops 604*a*, 604*c* in this embodiment can be square or rectangular.

In buff movement, the front follower block 606 is urged toward the distal end 5 of the center sill pocket 4 and engages the damping assembly 602. The front follower block 606 further travels along the center sill pocket 4 and engages the side wall 614*a* of the longitudinal moveable member 614, defining a full buff position.

In draft movement, the rear follower block 607 is urged toward the proximal end 6 of the center sill pocket 4 until the rear follower block 607 engages the intermediate stop 604*c*, defining a full draft position.

Figure 18:
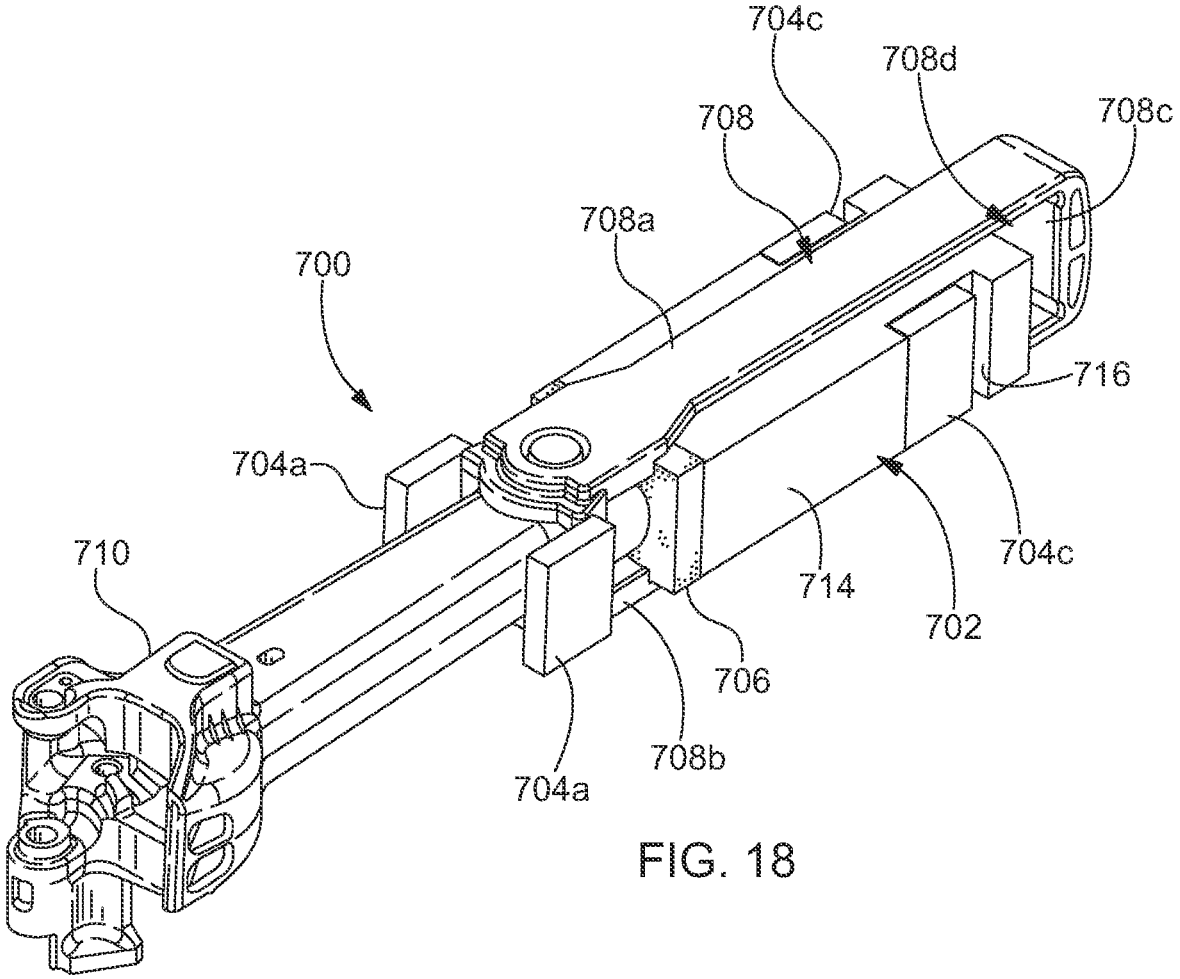
FIGS. 18-20 show another exemplary embodiment of the damping system, in a full buff, full draft, and neutral position, respectively.
Figure 19:
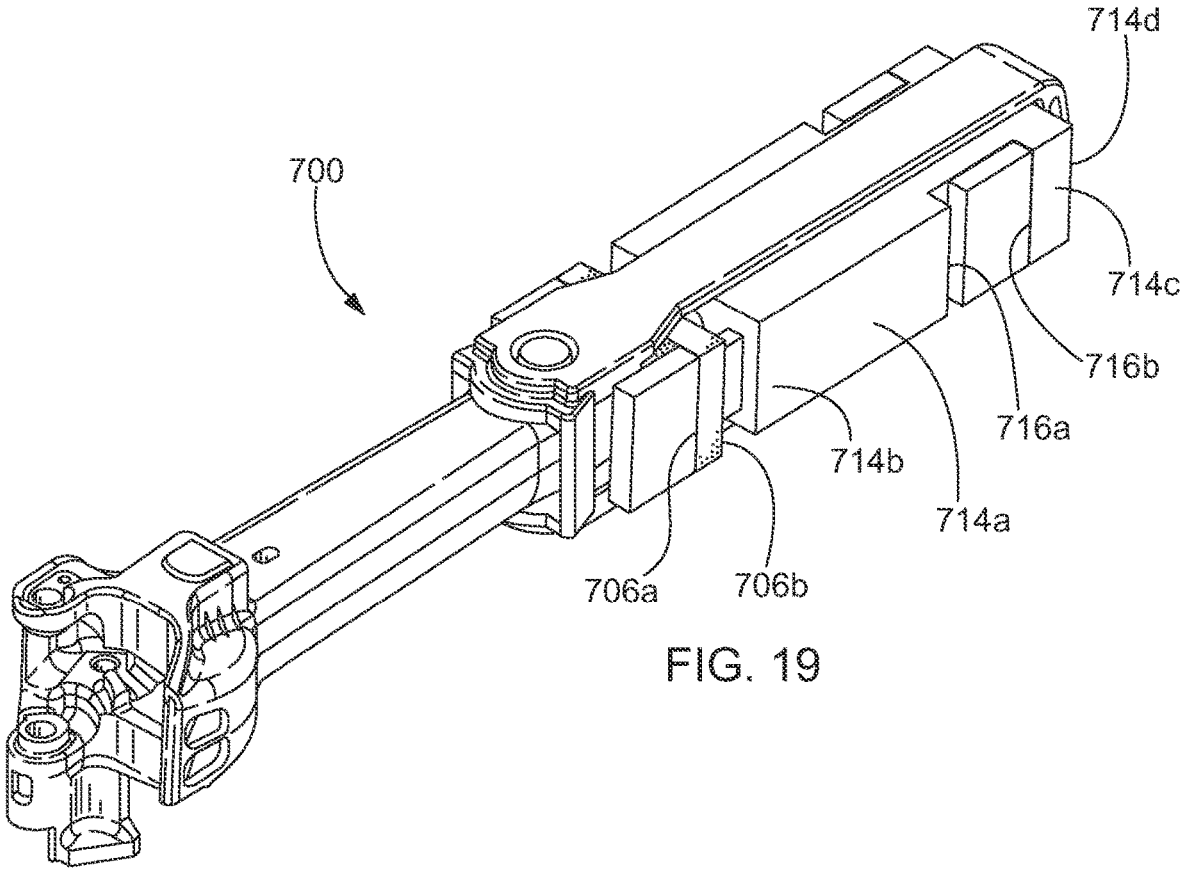
Figure 20:
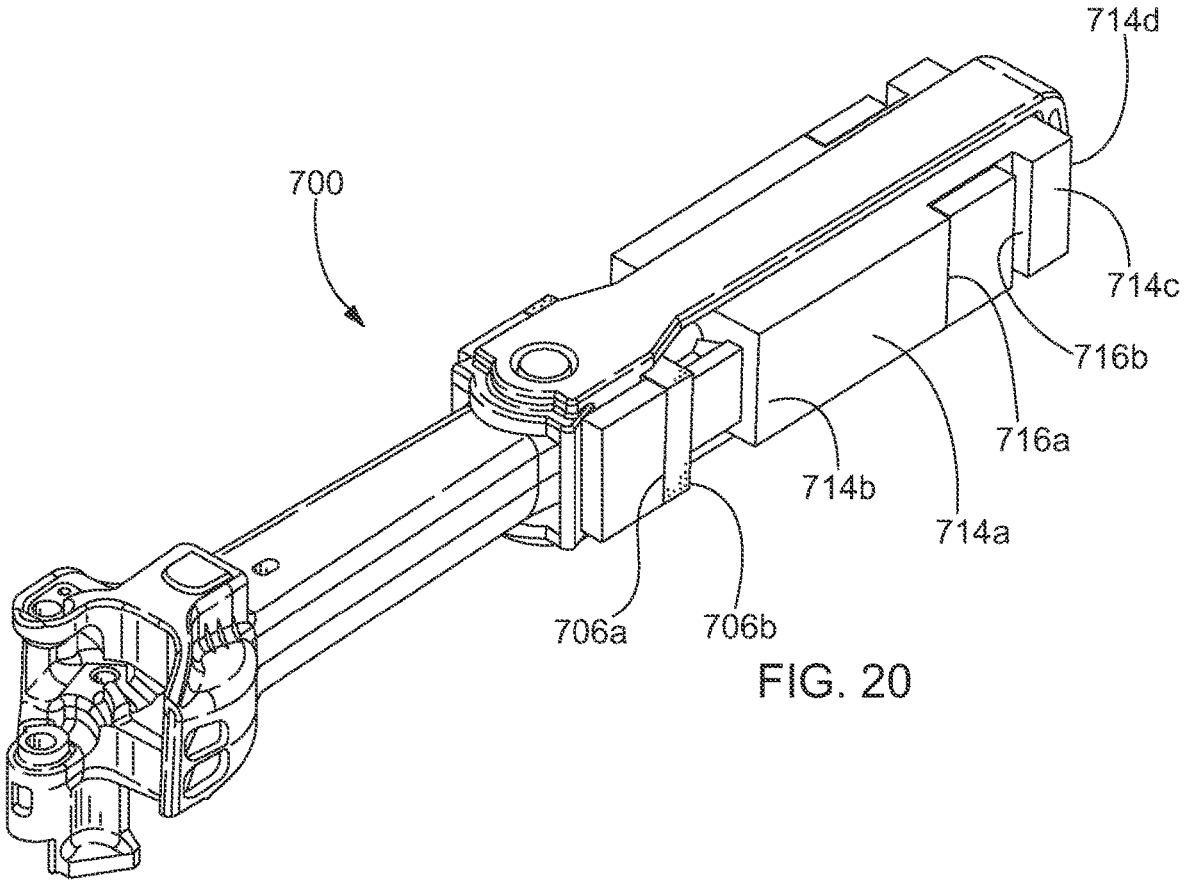

Referring to FIGS. 18-20, a sixth embodiment of the railcar damping system 700 is illustrated. The railcar center sill pocket 4 has longitudinally spaced front and intermediate stops 704*a*, 704*c*, defining a center sill pocket 4. The damping system 700 can have one or more front stops 704*a* and one or more intermediate stops 704*c*. For instance, the damping system 700 can have two front stops 704*a*, each positioned on either side of the frame 3 at a proximal end 6 of the center sill pocket 4. The damping system 700 can have two intermediate stops 704*c*, each positioned on either side of the frame 3 at a position between the proximal and distal ends 6, 5 of the center sill pocket 4. A yoke 708 is provided in the center sill pocket 4, the yoke 708 being an elongated member and oriented along the longitudinal axis 2. The yoke 708 has opposing top and bottom walls 708*a*, 708*b* extending longitudinally. The yoke 708 further has a distal end wall 708*c* connecting the top and bottom walls 708*a*, 708*b* to define a yoke pocket 708*d*. A damping assembly 702 (or damping means) is disposed in the yoke pocket 708*d*, and is configured for receiving and dissipating external forces acting on a coupler 710 connected to the yoke 708.

The damping system 700 includes a housing 714 having at least one side wall 714*a* extending longitudinally along the center sill pocket 4. The housing 714 has proximal and distal ends 714*b*, 714*c* and an end wall 714*d* connected to the side wall distal end 714*c*. The end wall is configured to be transverse to the longitudinal axis 2 and to extend into the yoke pocket 708*d*. The side wall 714*a* has a cut-out 716 formed in a surface thereof defining a proximal cut-out surface 716*a* and a distal cut-out surface 716*b*.

The damping system 700 has a follower block 706 positioned within the yoke pocket 708*d* for movement along the longitudinal axis 2. The follower block 706 is positioned transversely of the longitudinal axis 2. The follower block 706 has opposing proximal and distal facing stop sides 706*a*, 706*b*, and it is positioned between the front and intermediate stops 704*a*, 704*c*. The follower block 706 can be a planar member that is square or rectangular shaped.

The embodiment shown in FIGS. 18-20 has two front stops 704*a* and two intermediate stops 704*c*. Each front stop 704*a* is disposed at a proximal end 6 of the center sill pocket 4. Each intermediate stop 704*c* is disposed at a location between the proximal and distal ends 6, 5 of the center sill pocket 4. The front and intermediate stops 704*a*, 704*c* in this embodiment can be square or rectangular.

In buff movement, the follower block 706 is urged toward the distal end 5 of the center sill pocket 4 and engages the damping assembly 702. The follower block 706 further travels along the center sill pocket 4 and engages the side wall 714*a* of the housing 714, defining a full buff position.

In draft movement, the housing 714 is urged toward the proximal end 6 of the center sill pocket 4 until the distal cut-out surface 716*b* engages the intermediate stop 704*c*, defining a full draft position.

One of the improvements provided by the inventive system is a configuration that incorporates a proximal stop surface and a distal stop surface. These may be formed on the stops, the longitudinal moveable member, the housing, etc. To achieve this, the various embodiments show I-shaped or H-shaped follower blocks, square or rectangle shaped follower blocks, plus shaped follower blocks, square or rectangle stops, T-shaped stops, C-shaped stops, T-shaped proximal ends of the longitudinal movable member or housing, etc. It is understood, however, that other shapes, configuration, arrangements, and combinations thereof can be used. For instance, the stops can be L-shaped, any of the embodiments described using the I-shaped follower block can similarly use the plus shaped follower bock and vis-versa, etc. Thus, other shapes and configurations that allow for the use of proximal and distal stop surfaces to provide for differentiated draft and buff movements is contemplated and is therefore within the scope of this disclosure.

Figure 21:
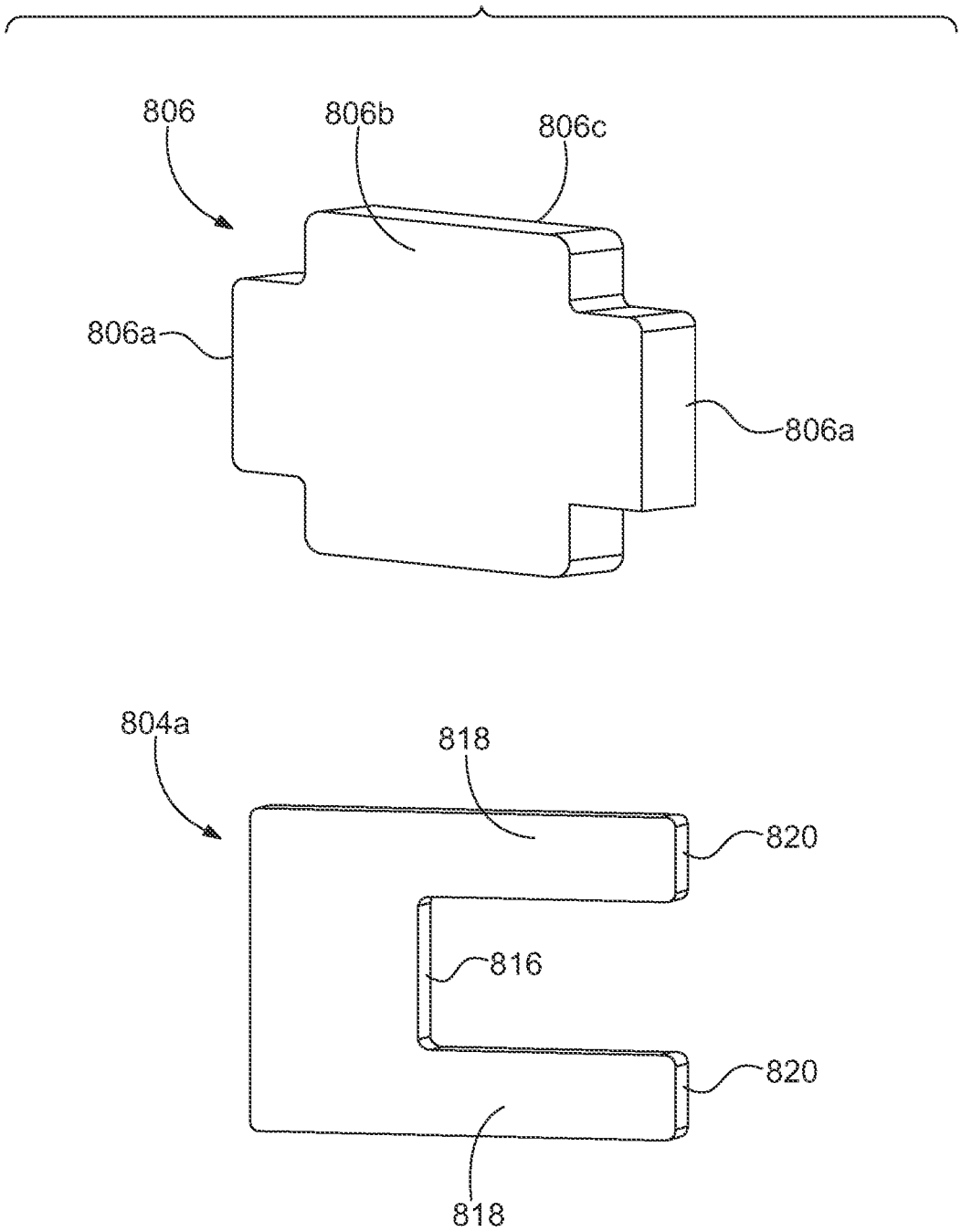
FIG. 21 shows additional exemplary follower block and stop configurations that may be used with an embodiment of the damping system.
Figure 22:
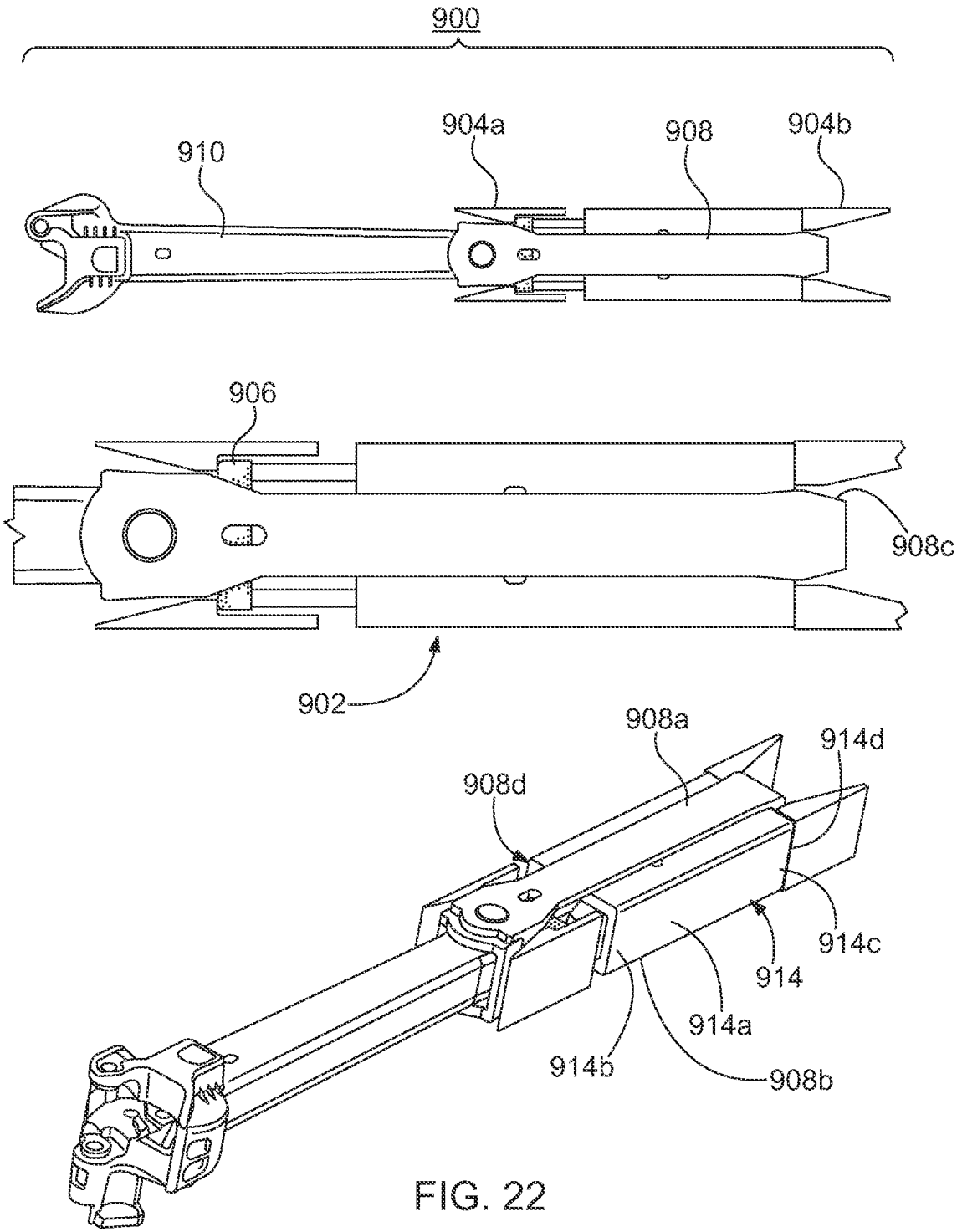
FIGS. 22-24 show another exemplary embodiment of the damping system in a neutral, full buff, and a full draft position, respectively.

For instance, FIG. 21 shows additional exemplary follower block 806 and front stop 804*a* configurations that may be used with various embodiments of the damping system described herein. The follower block 806 is positioned transversely of the longitudinal axis 2 and includes a protrusion 806*a* defining opposing proximal and distal facing stop sides 806*b*, 806*c*. For instance, the follower block 806 can be a planar member that is cross-shaped or plus-sign shaped, such a shape having a protrusion 806*a*. The front stop 804*a* includes a proximal stop surface 816 and two distally extending portions 818 extending longitudinally and terminating in two distal stop surfaces 820. For instance, the front stop 804*a* (and also the housing and sidewalls) can be a planar member that is C-shaped, such shape having the two distally extending portions 818. One skilled in the art will appreciate that other geometric shapes can be implemented in accordance with the spirit and scope of the present invention.

Referring to FIGS. 22-25, a seventh embodiment of the railcar damping system 900 is illustrated. In an exemplary embodiment, the railcar damping system 900 is configured for placement in a railcar center sill having longitudinally spaced front and rear stops 904*a*, 904*b* defining a center sill pocket 4. The railcar damping system 900 includes a yoke 908 provided in the center sill pocket 4. The yoke 908 has a longitudinal axis. The yoke 908 further has opposing top and bottom walls 908*a*, 908*b* extending longitudinally. The yoke 908 also has a distal end wall 908*c* connecting the top and bottom walls 908*a*, 908*b* to define a yoke pocket 908*d*.

The railcar damping system 900 includes a damping assembly 902 that is disposed in the yoke pocket 908*d*. The damping assembly 902 is configured for receiving and dissipating external forces acting on a coupler 910 connected to the yoke 908.

The railcar damping system 900 includes a longitudinally moveable member 914, which may be a housing having a sidewall 914*a* or only a sidewall 914*a*, extending longitudinally along the center sill pocket 4. The longitudinally moveable member 914 has proximal and distal ends 914*b*, 914*c* and an end wall 914*d* connected to the side wall distal end 914*c*, wherein the end wall 914*d* is transverse to the longitudinal axis 2 and extends into the yoke pocket 908*d*.

The railcar damping system 900 includes a follower block 906 provided within the yoke pocket 908*d* for movement along the longitudinal axis 2. The follower block 906 is positioned transversely of the longitudinal axis 2 and includes opposing proximal and distal facing stop sides 906*a*, 906*b*, respectively. The follower block 906 can have a square or rectangular shape.

The front stops 904*a* are disposed at a proximal end of the center sill pocket 4 and the rear stops 904*b* are disposed at a distal end of the center sill pocket 4. The front stops 904*a* include a proximal stop surface 916 formed on the front stop inner surface 922, and a distally extending portion extending longitudinally and terminating in a distal stop surface 918. The proximal stop surface 916 is in the form of a flange or protrusion 920 (e.g., a step, a wedge formation, etc.) extending from the front stop inner surface 922, with the front stop inner surface being generally smooth.

Figure 23:
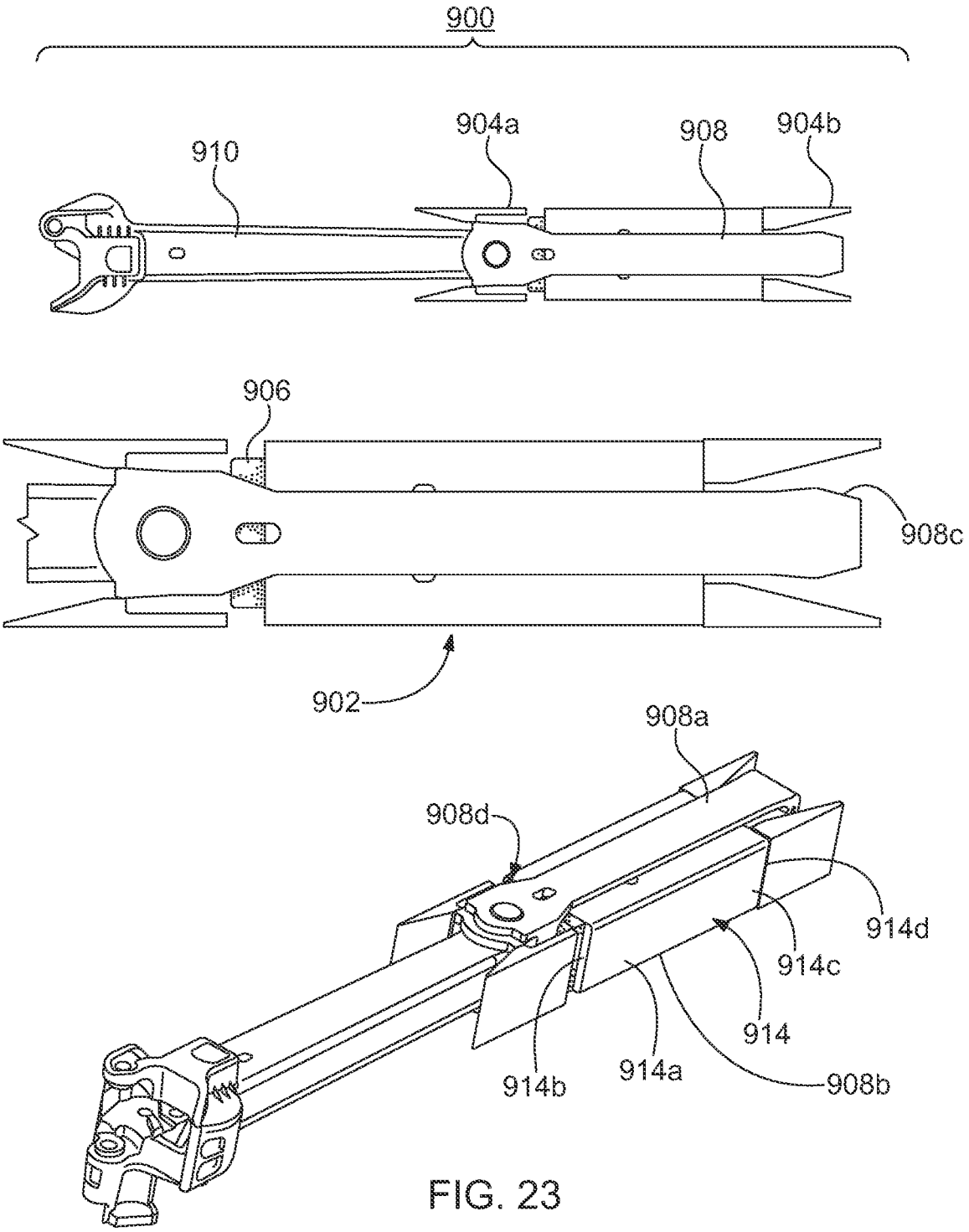

In buff movement, as shown in FIG. 23, the follower block 906 is urged toward the distal end of the center sill pocket and engages the damping assembly 902. The follower block 906 travels along the inner surface 922 of the front stop 904*a* and along the distally extending portion of the front stop 904*a* to engage the longitudinally moveable member 914. As the buff motion continues, the front follower block 906 presses against the damping assembly 902 to cause compression of the damping assembly until the damping assembly 902 experiences full compression. When the damping assembly 902 is caused to move in buff motion, the rear stops 904*b* arrest movement of the longitudinally moveable member 914 beyond a certain point. This arrested movement of the longitudinally moveable member 914 (or housing) allows the follower block 906 to fully compress the damping assembly 902. When the longitudinally moveable member 914 movement is arrested and the damping assembly 902 is fully compressed, this defines a full buff position.

Figure 24:
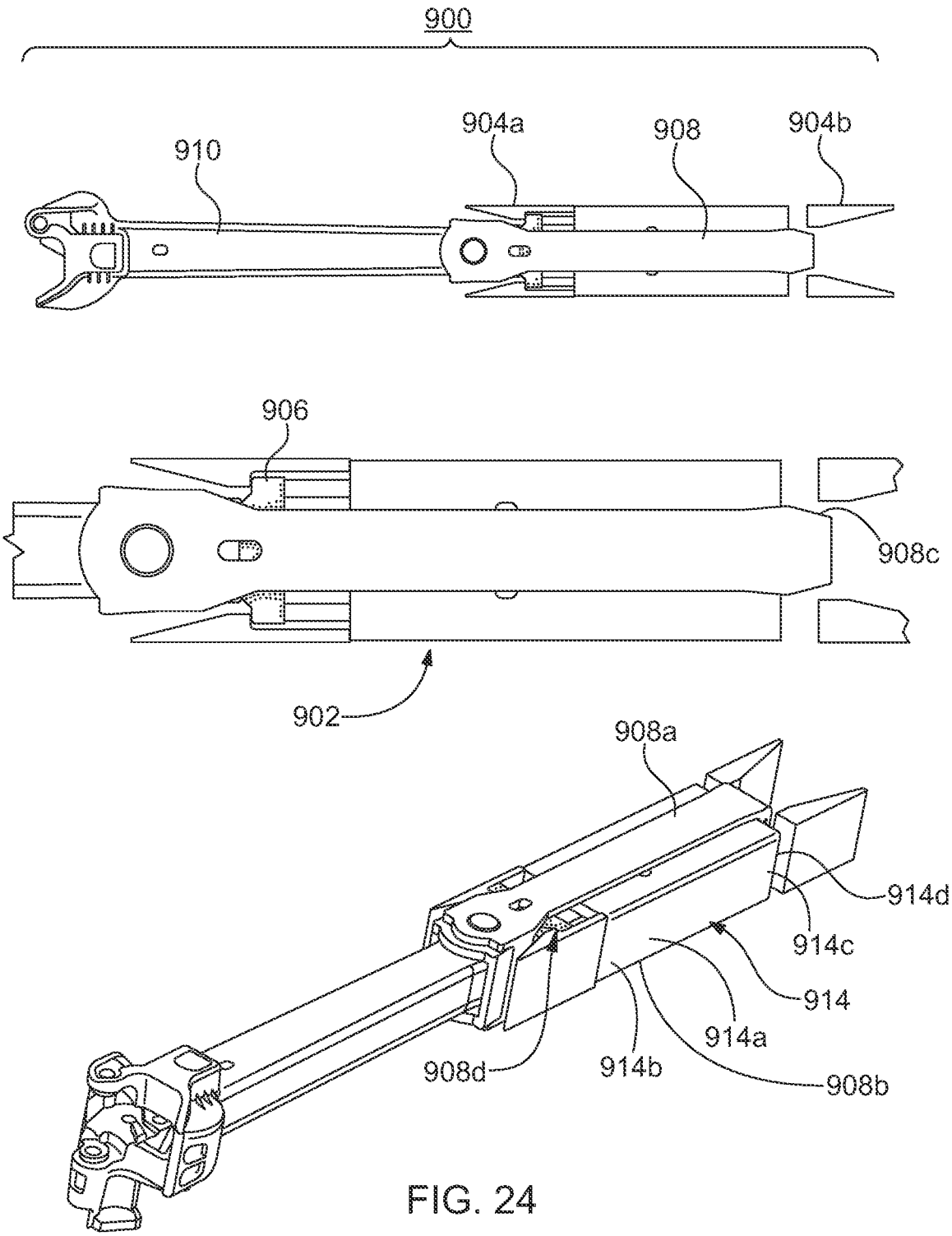
Figure 25:
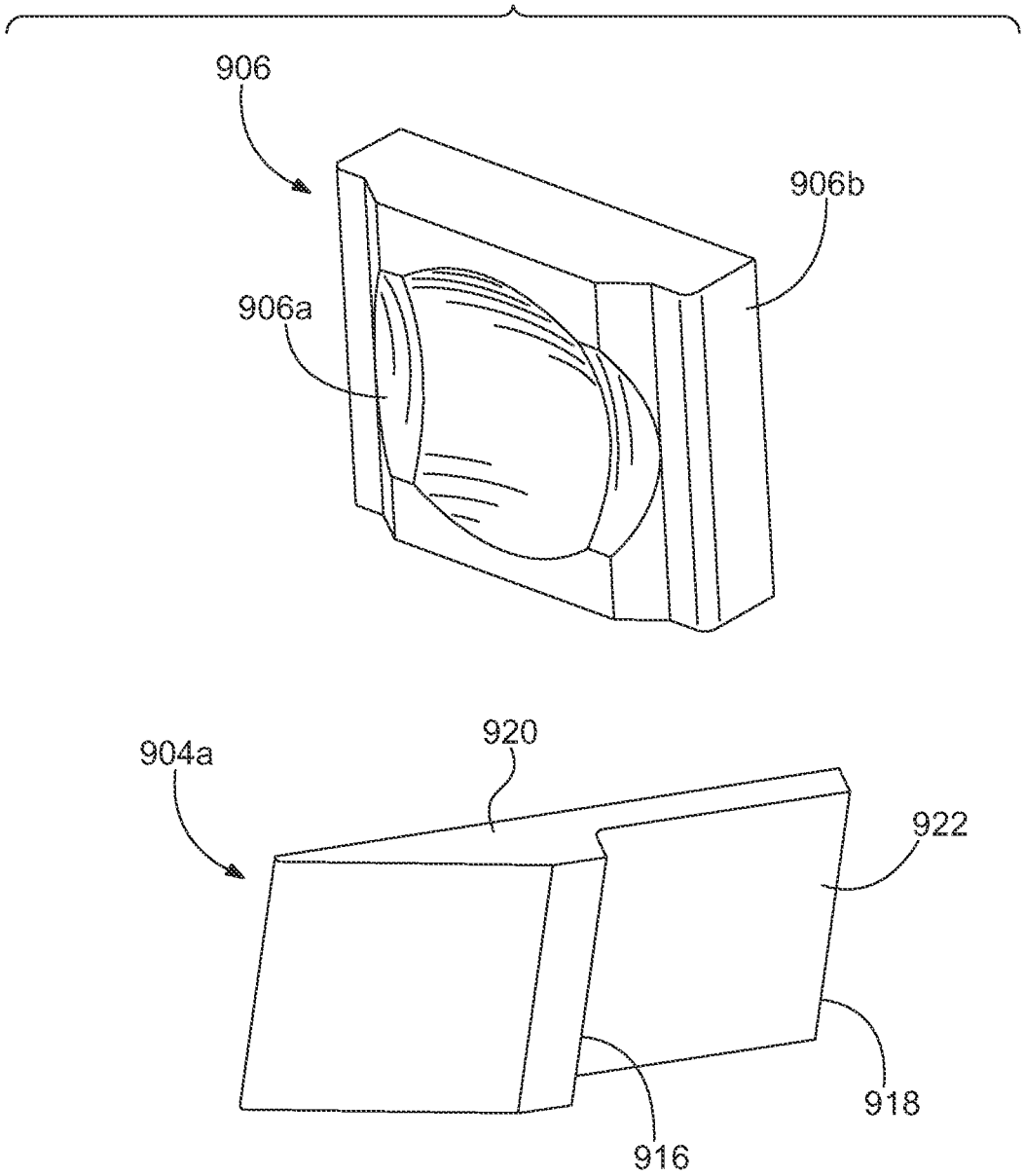
FIG. 25 shows an exemplary follower block and an exemplary front stop that may be used with the embodiments shown in FIGS. 22-24.
Figure 26:
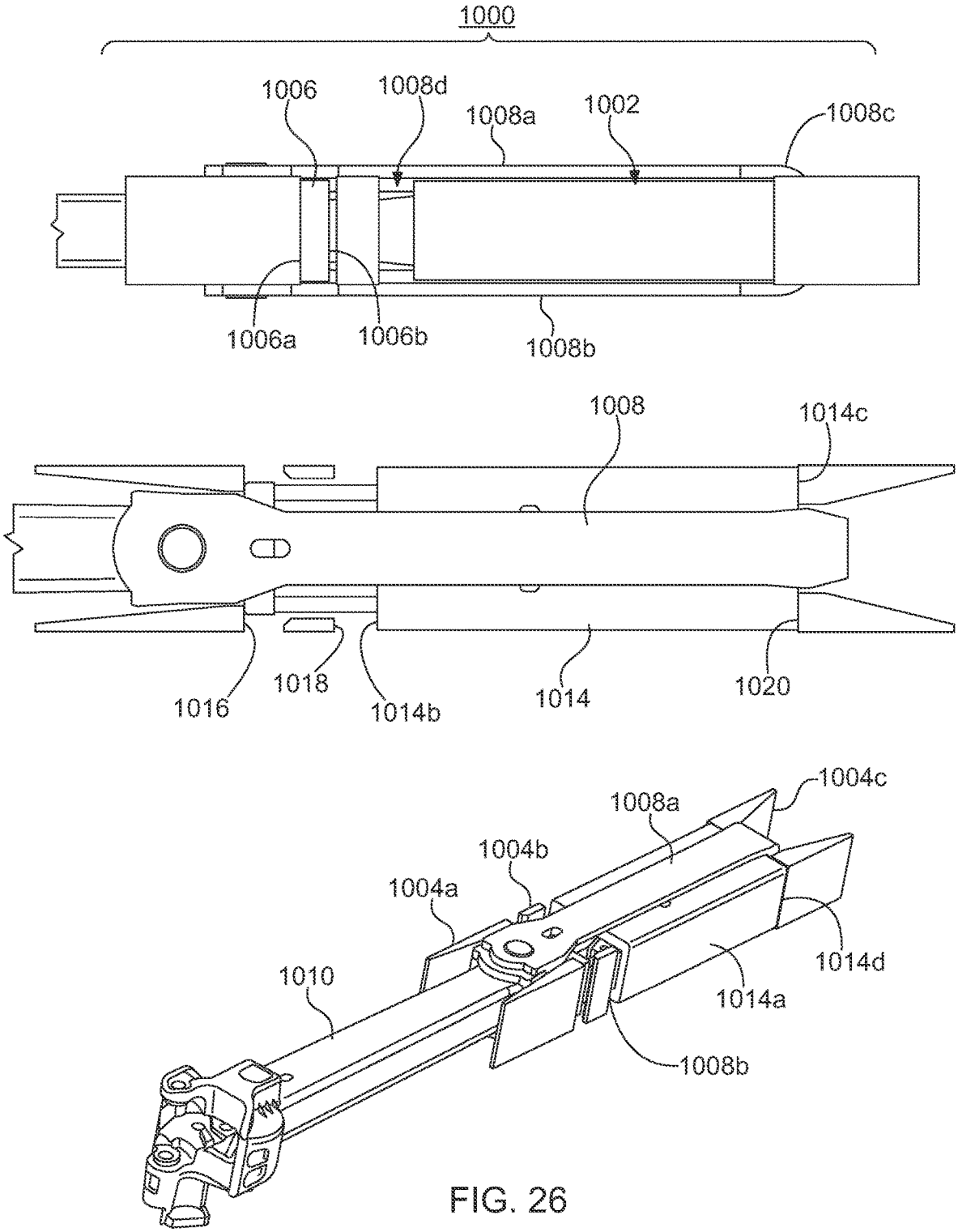
FIGS. 26-28 show an exemplary embodiment of the railcar damping system having a square shaped follower block, the damping system being in a neutral position, a full buff position, and a full draft position, respectfully.

In draft movement, as shown in FIG. 24, the longitudinally moveable member 914 is urged toward the proximal end of the center sill pocket. During such movement, the follower block 906 will travel along the front stop inner surface 922 and engage the proximal stop surface 916 of the front stops 904*a*. The damping assembly 902 pushes against the follower block 906, but because the follower block 906 is held stationary by the proximal stop surface 916, the damping assembly 902 begins to compress. The movement of the coupler 910 and yoke 902, as well as the compression of the damping assembly 902, continues until the longitudinally moveable member 914 abuts the distal stop surface 918 of the front stops 904*a*, thereby arresting any further movement of the longitudinally moveable member 914 towards the center sill pocket proximal end 6. This defines a full draft position.

The follower block 906 can have opposing side ends trimmed off so that it may travel along the front stop inner surface 922 and engage the proximal stop surface 916. This allows the damping system 902 to be compressed fully in the buff motion for maximum energy absorption, while limiting travel in the draft motion by not permitting full compression of the damping assembly 902 so as to reduce inter-car slack.

Referring to FIGS. 26-33, an eighth embodiment of the railcar damping system 1000 is illustrated. This embodiment is shown with a square shaped follower block arrangement (see FIG. 29) or an H-shaped follower block arrangement (see FIG. 33). The railcar damping system 1000 is configured for placement in a railcar center sill having longitudinally spaced front, intermediate, and rear stops 1004*a*, 1004*b*, and 1004*c*, respectively, defining a center sill pocket 4. The railcar damping system 1000 includes a yoke 1008 provided in the center sill pocket 4. The yoke 1008 has a longitudinal axis. The yoke 1008 further has opposing top and bottom walls 1008*a*, 1008*b* extending longitudinally. The yoke 1008 also has a distal end wall 1008*c* connecting the top and bottom walls 1008*a*, 1008*b* to define a yoke pocket 1008*d*.

The railcar damping system 1000 includes a damping assembly 1002 that is disposed in the yoke pocket 1008*d*. The damping assembly 1002 is configured for receiving and dissipating external forces acting on a coupler 1010 connected to the yoke 1008.

The railcar damping system 1000 includes a longitudinally moveable member 1014 having a sidewall 1014*a* extending longitudinally along the center sill pocket 4. The longitudinally moveable member 1014 has proximal and distal ends 1014*b*, 1014*c* and an end wall 1014*d* connected to the side wall distal end 1014*c*, wherein the end wall 1014*d* is transverse to the longitudinal axis 2 and extends into the yoke pocket 1008*d*.

The railcar damping system 1000 includes a follower block 1006 provided within the yoke pocket 1008*d* for movement along the longitudinal axis 2. The follower block 1006 is positioned transversely of the longitudinal axis 2 and includes opposing proximal and distal facing stop sides 1006*a*, 1006*b*, respectively. The follower block 1006 is shown as having a generally square shape (FIGS. 26-28) or an H-shape (FIGS. 30-33); however, other geometric shapes are contemplated (e.g., rectangular shape, L-shape, etc.) and can be implemented in the various embodiments without departing from the spirit and scope of the present invention.

The front stops 1004*a* are disposed at a proximal end of the center sill pocket 4 and the rear stops 1004*c* are disposed at a distal end of the center sill pocket 4. The intermediate stops 1004*b* are disposed at an intermediate position between the proximal and distal ends of the center sill pocket 4. The front stops 1004*a* include a stop surface 1016 formed at a distal end of the front stop 1004*a*. In some embodiments, each front stop 1004*a* can be in the shape of a wedge, wherein the thicker edge forms the stop surface 1016; however, other geometric shapes are contemplated and can be implemented in the various embodiments without departing from the spirit and scope of the present invention. The intermediate stops 1004*b* include a stop surface 1018 formed at a distal end of the intermediate stop 1004*b*. The rear stops 1004*c* include a stop surface 1020 formed at a proximal end of the rear stop 1004*c*. In some embodiments, each rear stop 1004*c* is in the shape of a wedge, wherein the thicker edge forms the stop surface 1020; however, other geometric shapes are contemplated and can be implemented in the various embodiments without departing from the spirit and scope of the present invention.

Figure 27:
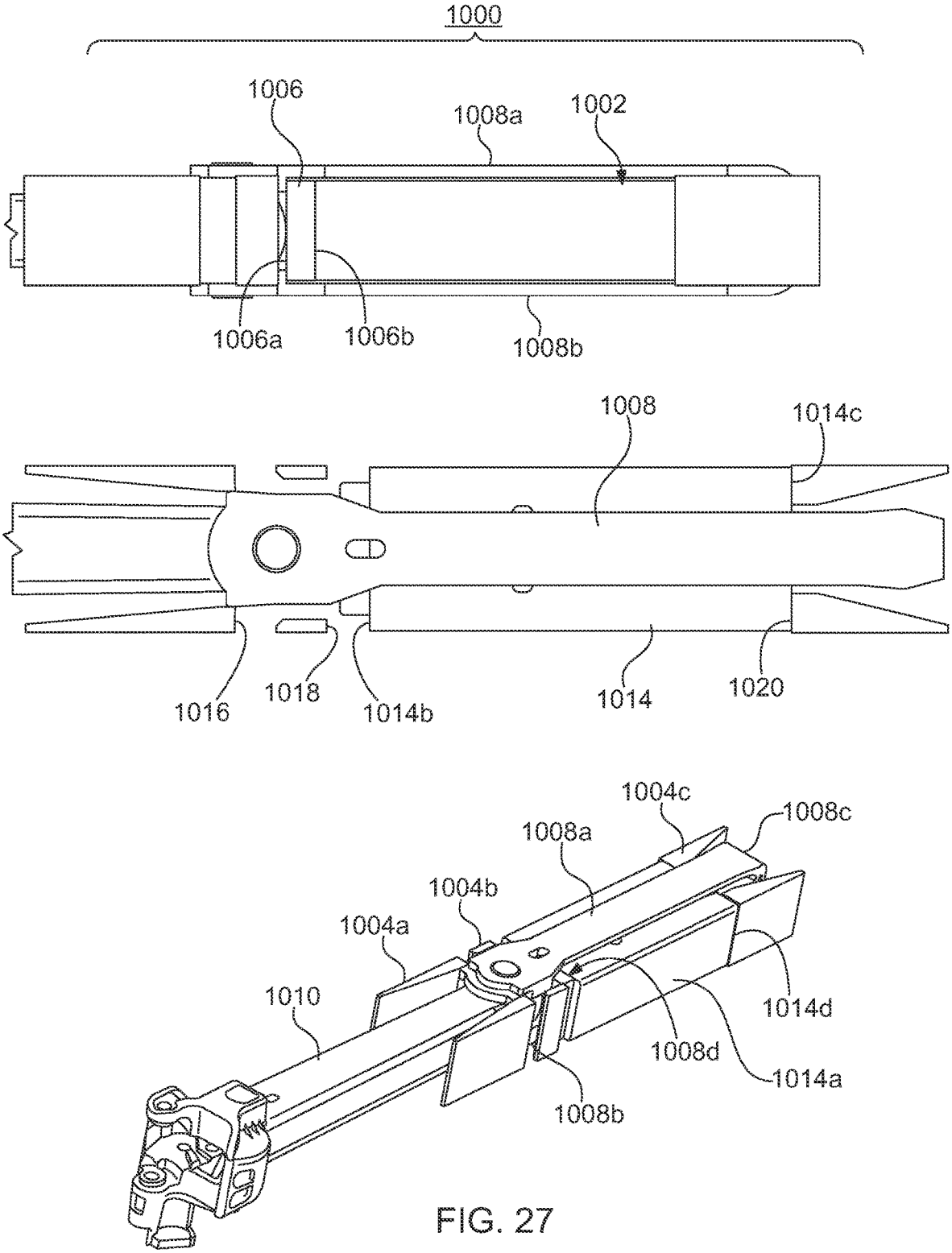
Figure 32:
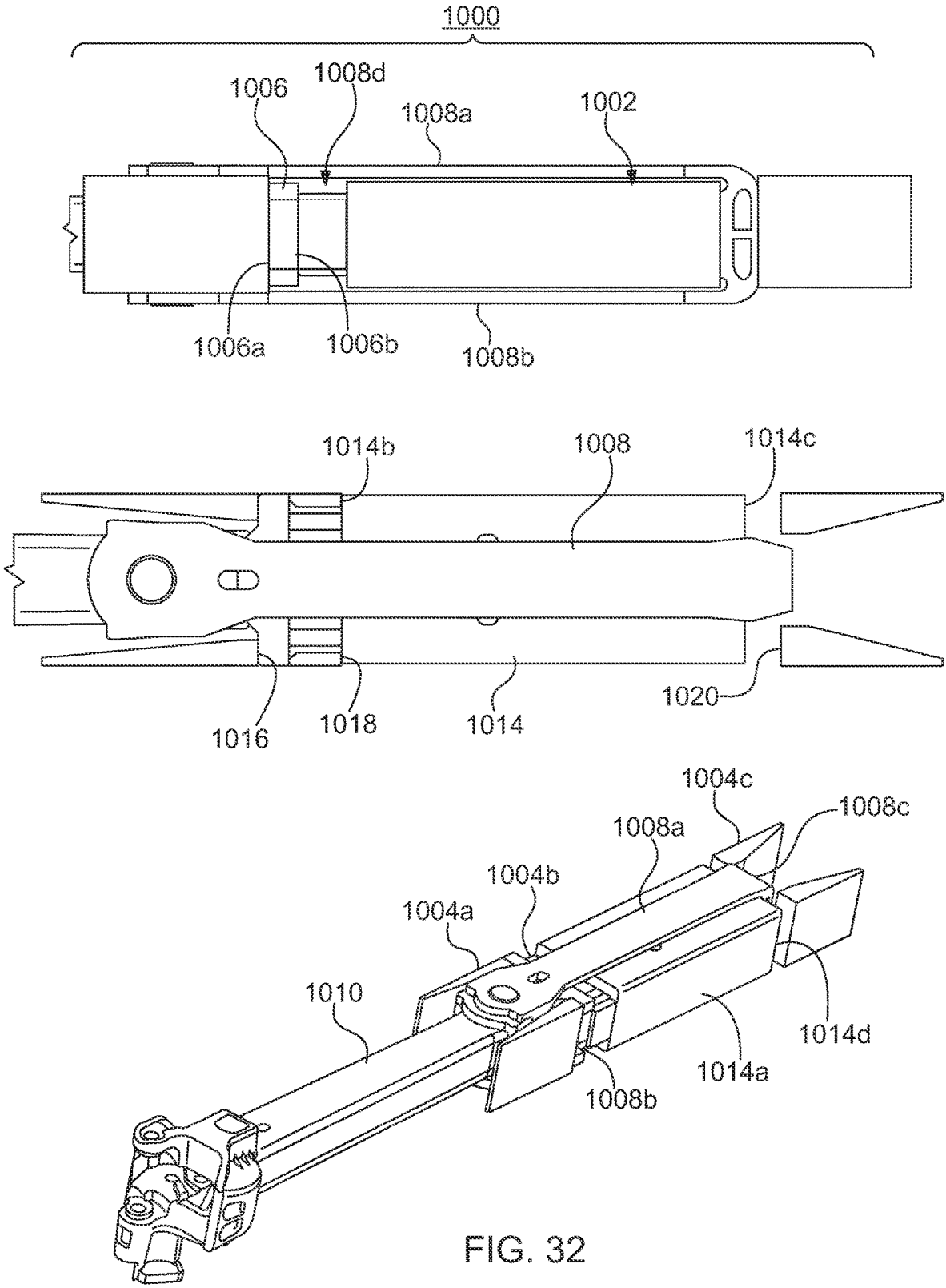

In buff movement, as shown in FIGS. 27 and 32, the follower block 1006 is urged toward the distal end of the center sill pocket 4 and engages the damping assembly 1002. The follower block 1006 travels past the intermediate stops 1004*b* and engages the longitudinally moveable member 1014. In FIGS. 26-29, the follower block 1006 moves along the inner surface of the intermediate stops 1004*b* due to its generally square shape. In FIGS. 30-33, the follower block includes protrusions or flanges that pass along the top and bottom surfaces of the intermediate stops 1004*b*. As the buff motion continues, the front follower block 1006 presses against the damping assembly 1002 to cause compression of the damping assembly until the damping assembly 1002 experiences full compression. When the damping assembly 1002 is caused to move in buff motion, a stop surface 1020 of the rear stops 1004*c* arrest movement of the longitudinally moveable member 1014 beyond a certain point. This arrested movement of the longitudinally moveable member 1014 allows the follower block 1006 to fully compress the damping assembly 1002. When the longitudinally moveable member 1014 movement is arrested and the damping assembly 1002 is fully compressed, this defines a full buff position.

Figure 28:
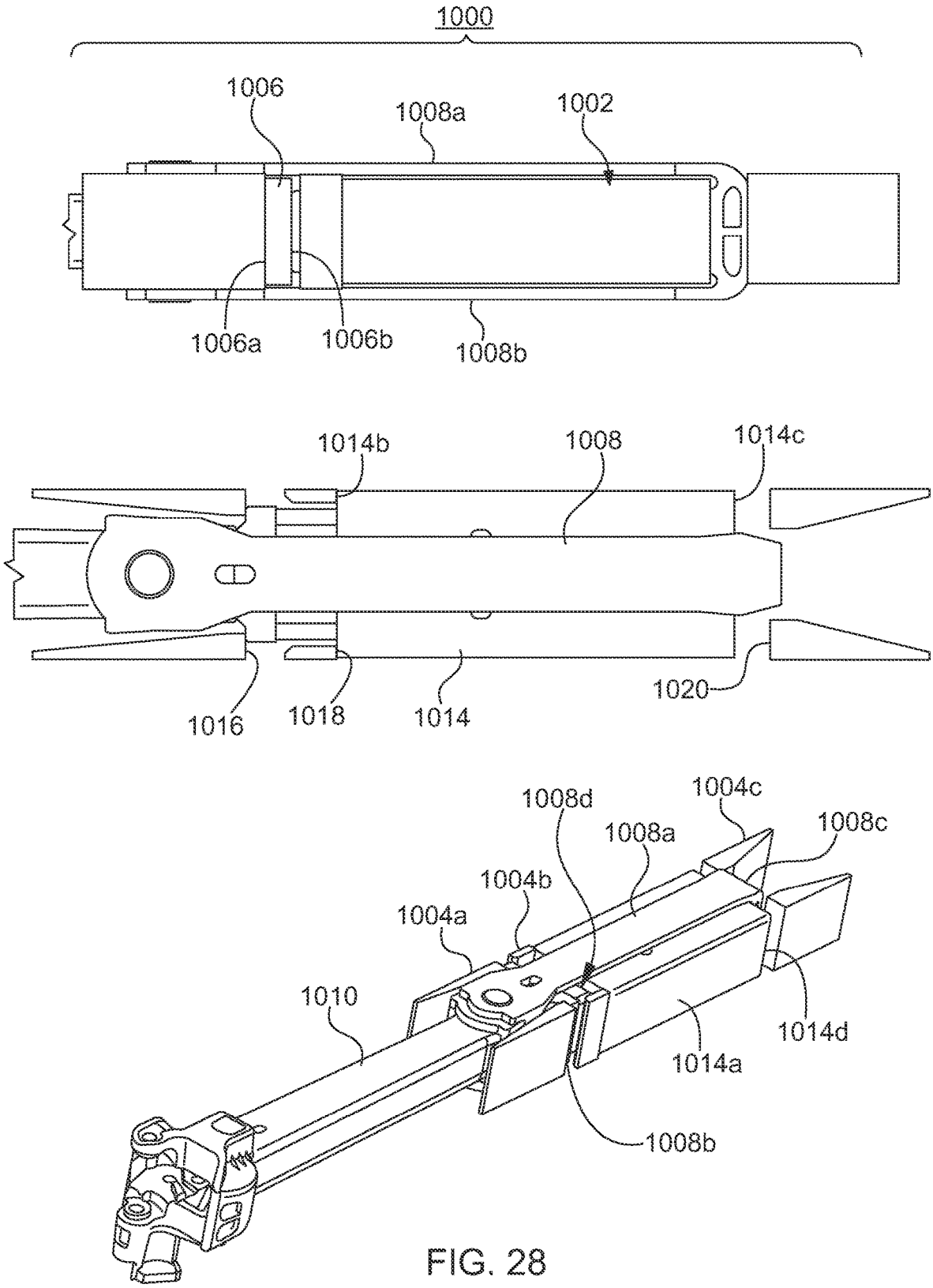

In draft movement, as shown in FIGS. 28 and 32, the longitudinally moveable member 1014 is urged toward the proximal end of the center sill pocket 4. During such movement, the follower block 1006 travels past the intermediate stops 1004*b* and engages the stop surface 1016 of the front stops 1004*a*. The damping assembly 1002 pushes against the follower block 1006, but because the follower block 1006 is held stationary by the stop surface 1016, the damping assembly 1002 begins to compress. The movement of the coupler 1010 and yoke 1008 as well as the compression of the damping assembly 1002, continues until the longitudinally moveable member 1014 abuts the stop surface 1018 of the intermediate stops 1004*b*, thereby arresting any further movement of the longitudinally moveable member 1014 towards the center sill pocket proximal end. This defines a full draft position.

Figure 29:
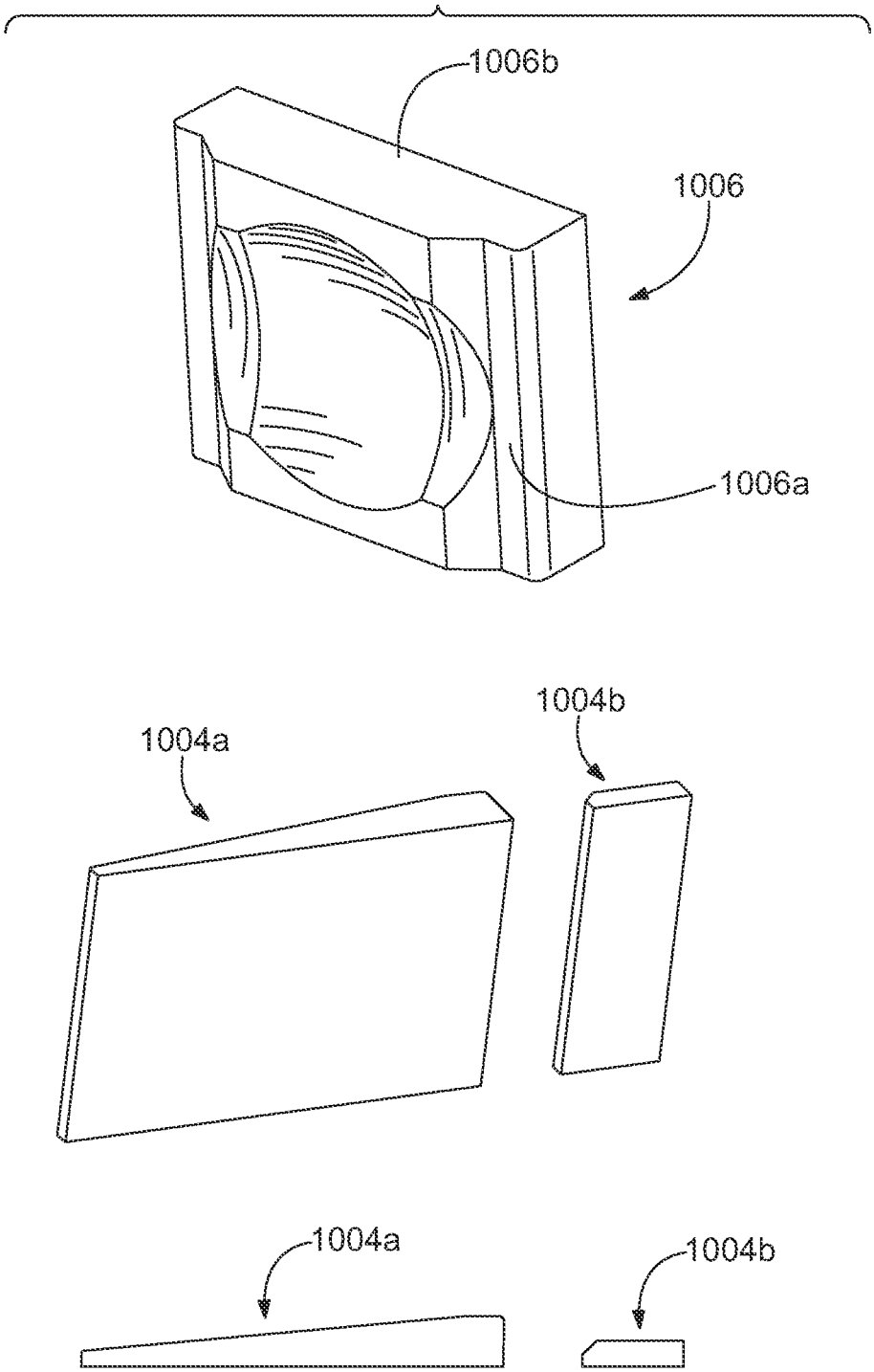
FIG. 29 shows an exemplary square shaped follower block and exemplary front and intermediate stops.
Figure 30:
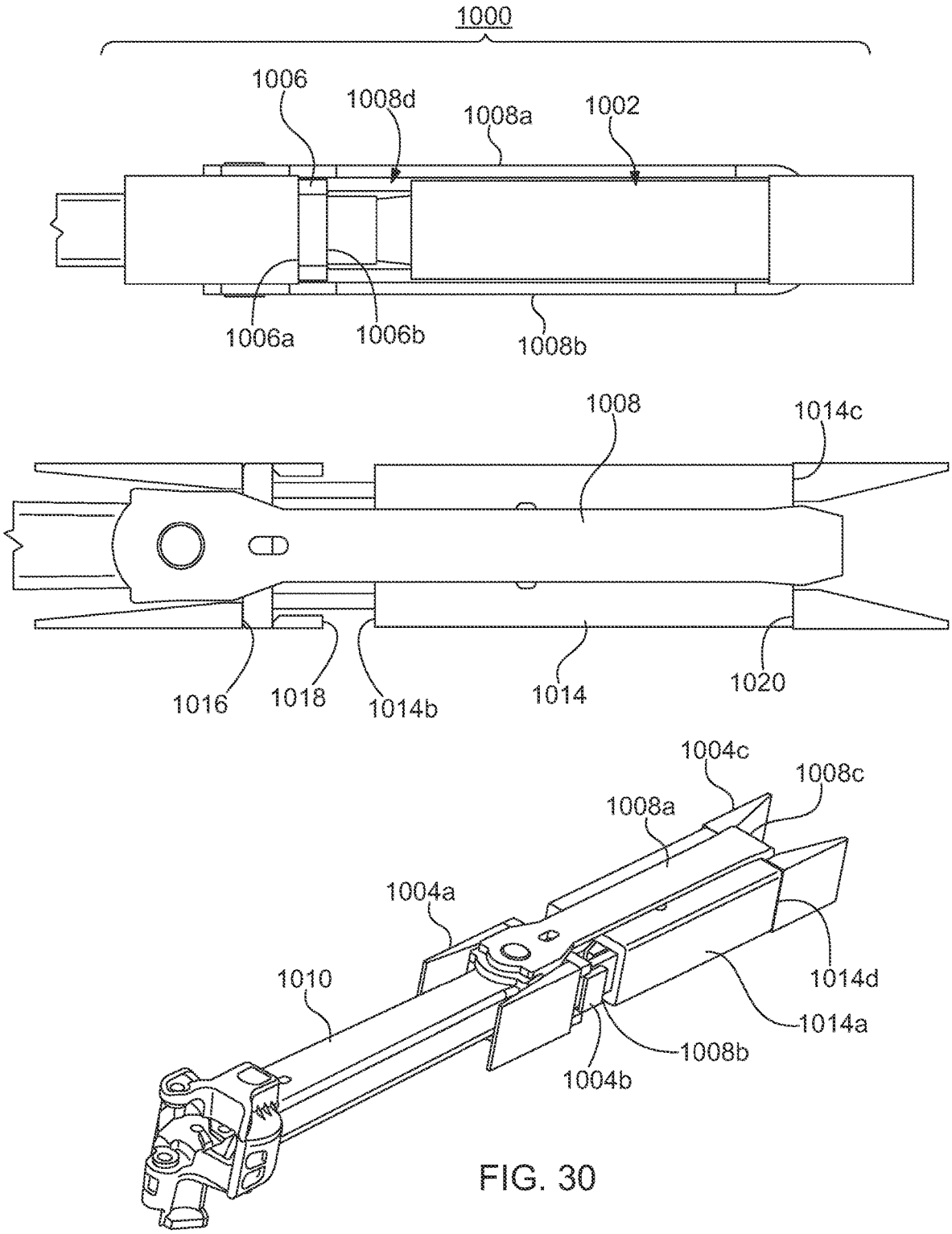
FIG. 30-32 show an exemplary embodiment of the railcar damping system having an H-shaped follower block, the damping system being in a neutral position, a full buff position, and a full draft position, respectively.
Figure 31:
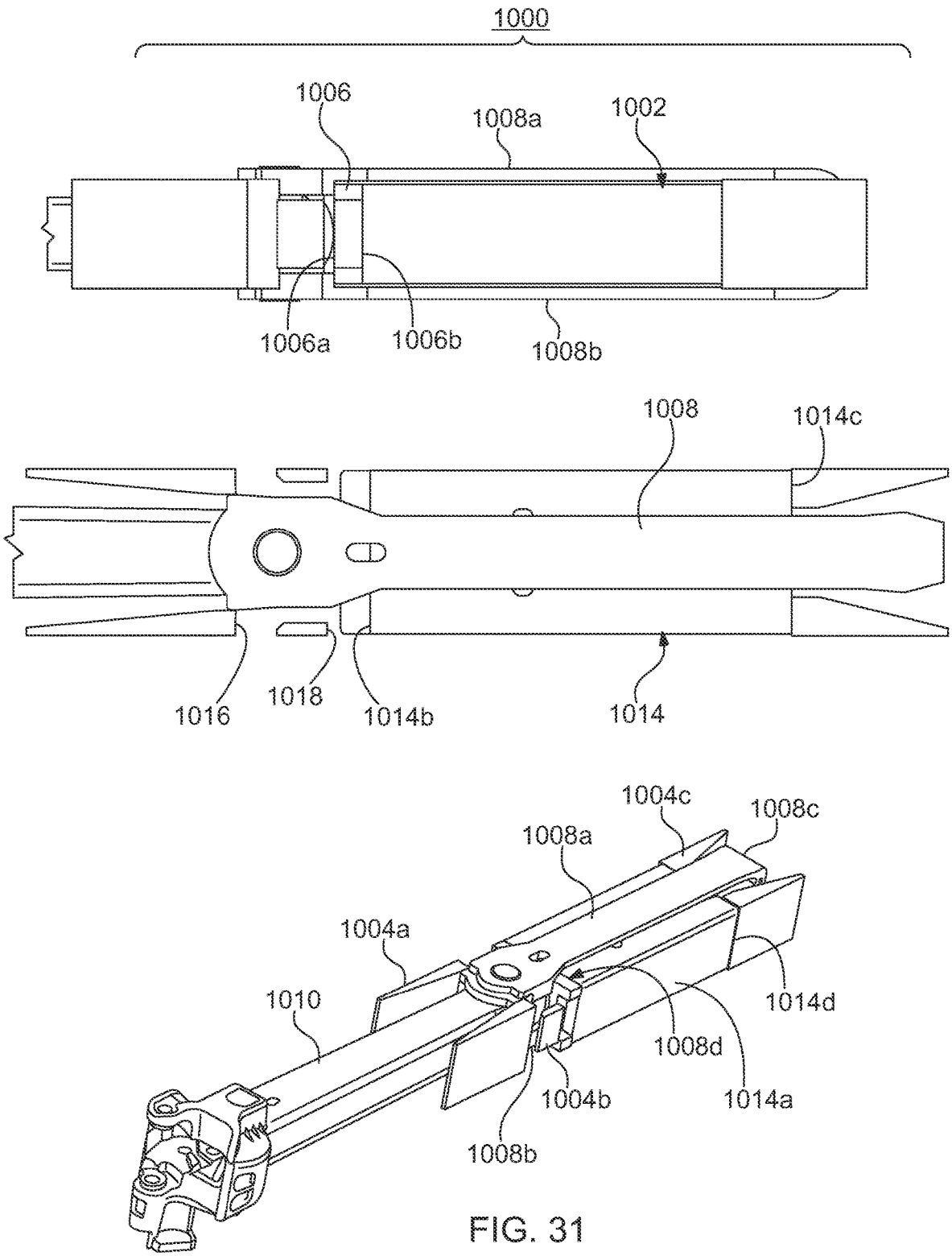
Figure 33:
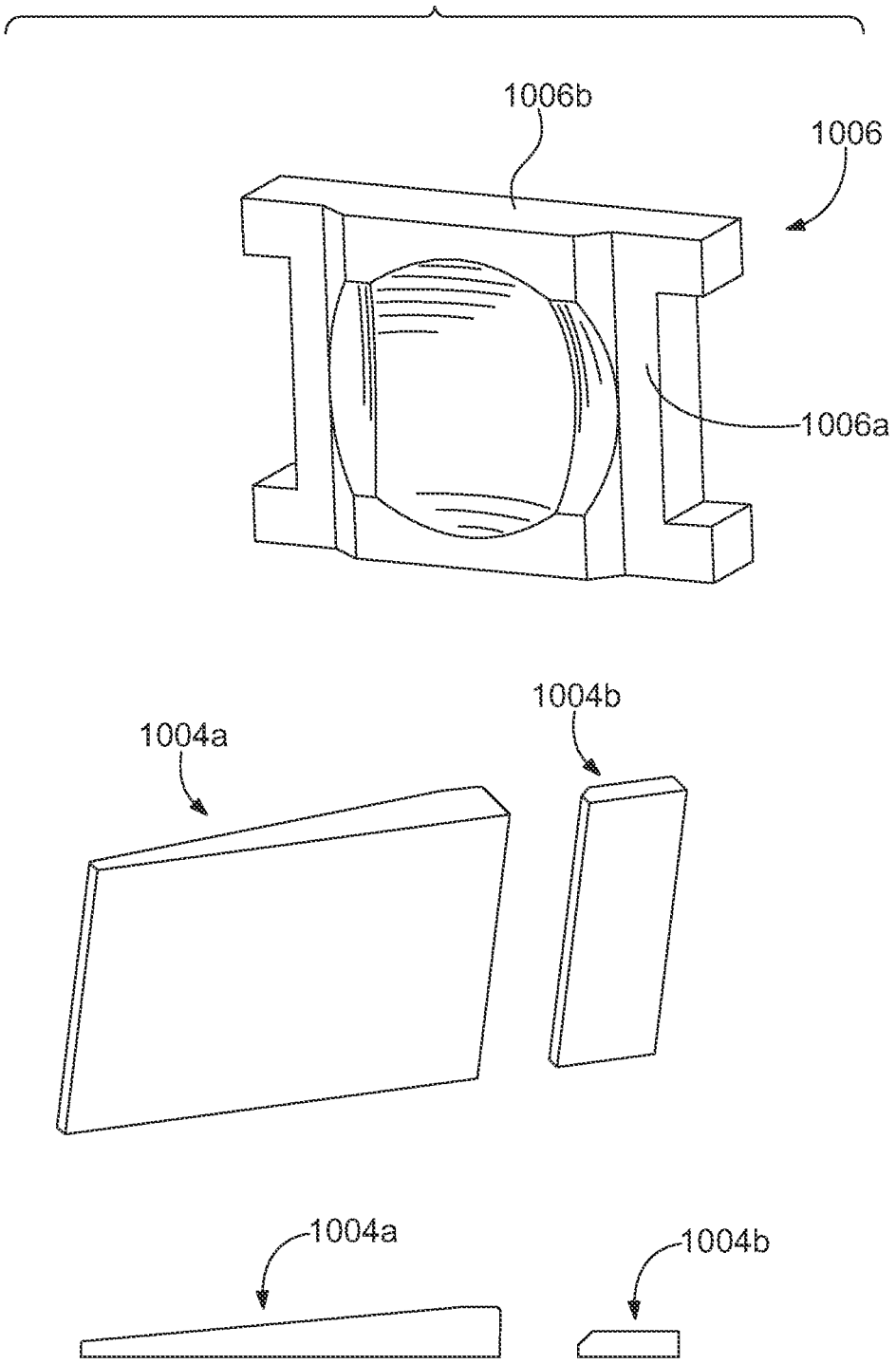
FIG. 33 shows an exemplary H-shaped follower block and exemplary front an intermediate stops.

FIG. 29 shows an exemplary generally square shaped follower block 1006, and FIG. 33 shows an exemplary H-shaped follower block 1006. With the square shaped follower block 1006 embodiments, the follower block 1006 is sized to slide along an inner surface of the intermediate stops 1004*b* but be in the path of the front stops 1004*a* (e.g., the wedge of the front stop 1004*a* extends inwards more so than that of the intermediate stop 1004*b* so the wedge portion is in the path of the follower block 1006 but the intermediate block 1006*b* is not). With the H-shaped follower block 1006 embodiments, the follower block 1006 has protrusions or flanges that allow the follower block 1006 to engage the front stop 1004*a* but pass over and under the intermediate stops 1004*b*. With the H-shaped follower block 1006 embodiments, the front stop 1004*a* may or may not be wedge shaped. Also, with the H-shaped follower block 1006 embodiments, the intermediate stop 1004*b* can be sized to fit within the protrusions or flanges of the H-shaped follower block 1006.

It is understood that any of the embodiments disclosed herein can be made and used with a longitudinal moveable member or a housing. For instance, an embodiment described using a longitudinal moveable member (or housing) can be used with a similarly shaped housing (longitudinal moveable member).

It should be understood that modifications to the embodiments disclosed herein can be made to meet a particular set of design criteria. For instance, the number of or configuration of components or parameters of the various embodiments may be interchangeably used to meet a particular objective.

It will be apparent to those skilled in the art that numerous modifications and variations of the described examples and embodiments are possible in light of the above teachings of the disclosure. The disclosed examples and embodiments are presented for purposes of illustration only. Other alternative embodiments may include some or all of the features of the various embodiments disclosed herein. For instance, it is contemplated that a particular feature described, either individually or as part of an embodiment, can be combined with other individually described features, or parts of other embodiments. The elements and acts of the various embodiments described herein can therefore be combined to provide further embodiments.

It is the intent to cover all such modifications and alternative embodiments as may come within the true scope of this invention, which is to be given the full breadth thereof. Additionally, the disclosure of a range of values is a disclosure of every numerical value within that range, including the end points. Thus, while certain exemplary embodiments of the device and methods of making and using the same have been discussed and illustrated herein, it is to be distinctly understood that the invention is not limited thereto but may be otherwise variously embodied and practiced within the scope of the following claims.

What is claimed is:

1. A railcar damping system configured for placement in a railcar center sill having longitudinally spaced front and rear stops defining a center sill pocket, said railcar damping system comprising:

a yoke provided in the center sill pocket and having a longitudinal axis, the yoke including opposing top and bottom walls extending longitudinally and including a distal end wall connecting the top and bottom walls to define a yoke pocket;

a damping assembly disposed in the yoke pocket and configured for receiving and dissipating external forces acting on a coupler connected to the yoke, the damping assembly including a member having a side wall extending longitudinally along the center sill pocket and having proximal and distal ends and an end wall connected to the side wall distal end, the end wall transverse to the longitudinal axis and extending into the yoke pocket;

a follower block provided within the yoke pocket for movement along the longitudinal axis, the follower block positioned transversely of the longitudinal axis and including a flange portion defining opposing proximal and distal facing stop sides;

wherein the front stop is disposed at a proximal end of the center sill pocket and the rear stop is disposed at a distal end of the center sill pocket;

wherein the front stop includes a proximal stop surface and a distally extending portion extending longitudinally and terminating in a distal stop surface;

wherein in buff movement, the follower block is urged toward the distal end of the center sill pocket and engages the damping assembly, the flange portion of the follower block travels along the distally extending portion of the front stop and engages the side wall of the member defining a full buff position;

wherein in draft movement, the member is urged toward the proximal end of the center sill pocket until the proximal end of the member engages the distal stop surface of the front stop defining a full draft position.

2. The railcar damping system of claim 1, wherein:

the member is a longitudinally moveable member, wherein:

in buff movement, the follower block is urged toward the distal end of the center sill pocket and engages the damping assembly, the flange portion of the follower block travels along the distally extending portion of the front stop and engages the side wall of the longitudinally moveable member defining a full buff position;

in draft movement, the longitudinally moveable member is urged toward the proximal end of the center sill pocket until the proximal end of the longitudinally moveable member engages the distal stop surface of the front stop defining a full draft position;

or;

the member is a housing, wherein:

in buff movement, the follower block is urged toward the distal end of the center sill pocket and engages the damping assembly, the flange portion of the follower block travels along the distally extending portion of the front stop and engages the side wall of the housing defining a full buff position;

in draft movement, the housing is urged toward the proximal end of the center sill pocket until the proximal end of the housing engages the distal stop surface of the front stop defining a full draft position.

3. The railcar damping system of claim 1, wherein the damping system is configured to facilitate full compression of the damping assembly in buff movement but partial compression of the damping assembly in draft movement.

4. The railcar damping system of claim 1, wherein:

the front stop includes a proximal stop surface and two distally extending portions extending longitudinally and terminating in two distal stop surfaces;

in buff movement, the follower block is urged toward the distal end of the center sill pocket and engages the damping assembly, the flange portion of the follower block travels along the two distally extending portions of the front stop and engages the side wall of the member defining a full buff position;

in draft movement, the member is urged toward the proximal end of the center sill pocket until the proximal end of the member engages the two distal stop surfaces of the front stop defining a full draft position.

* * * * *